US007703895B2

(12) United States Patent
Lee et al.

(10) Patent No.: US 7,703,895 B2
(45) Date of Patent: Apr. 27, 2010

(54) PIEZOELECTRIC INKJET PRINTHEAD AND METHOD OF MANUFACTURING THE SAME

(75) Inventors: Jae-chang Lee, Hwaseong-si (KR); Jae-woo Chung, Suwon-si (KR); Sung-gyu Kang, Suwon-si (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 895 days.

(21) Appl. No.: 11/333,540

(22) Filed: Jan. 18, 2006

(65) Prior Publication Data

US 2006/0181580 A1 Aug. 17, 2006

(30) Foreign Application Priority Data

Jan. 18, 2005 (KR) ..... 10-2005-0004454

(51) Int. Cl.
*B41J 2/045* (2006.01)

(52) U.S. Cl. ..... 347/68; 347/71

(58) Field of Classification Search ..... 347/70, 347/71

See application file for complete search history.

(56) References Cited

U.S. PATENT DOCUMENTS 5,856,837 A 1/1999 Kitahara et al.
2003/0067513 A1* 4/2003 Eguchi et al. ..... 347/70
2003/0112300 A1* 6/2003 Chung et al. ..... 347/71

FOREIGN PATENT DOCUMENTS

| | | |
|---|---|---|
| EP | 0 985 534 A1 | 3/2000 |
| EP | 1 275 507 A1 | 1/2003 |
| JP | 09-239978 | 9/1997 |
| KR | 10-2004-0073120 | 8/2004 |
| WO | WO 97/34769 | 9/1997 |

OTHER PUBLICATIONS

Patent Abstracts of Japan; vol. 1998, No. 02, Jan. 30, 1998 & JP 09 277531.

* cited by examiner

*Primary Examiner*—Matthew Luu
*Assistant Examiner*—Lisa M Solomon
(74) *Attorney, Agent, or Firm*—Lee & Morse, P.C.

(57) ABSTRACT

A piezoelectric inkjet printhead including an upper substrate, having an ink inlet, a manifold connected with the ink inlet, and a plurality of pressure chambers arranged along at least one side of the manifold, wherein the ink inlet passes through the upper substrate, and the manifold and the pressure chambers are formed in a lower surface of the upper substrate, a lower substrate disposed directly adjacent the upper substrate, the lower substrate having a plurality of restrictors each connecting the manifold with one end of each of the pressure chambers, and a plurality of nozzles each being formed in a position of the lower substrate that corresponds to the other end of each of the pressure chambers to vertically pass through the lower substrate, wherein the plurality of restrictors are formed in an upper surface of the lower substrate, and a plurality of piezoelectric actuators.

35 Claims, 14 Drawing Sheets

PIEZOELECTRIC INKJET PRINTHEAD AND METHOD OF MANUFACTURING THE SAME

BACKGROUND OF THE INVENTION

1. Field of the Invention

The present invention relates to an inkjet printhead. More particularly, the present invention relates to a piezoelectric inkjet printhead manufactured from two silicon substrates, and a method of manufacturing the same.

2. Description of the Related Art

An inkjet printhead is a device that ejects fine ink droplets onto a desired position of a print medium in order to print an image of a predetermined color. Inkjet printheads may be roughly classified into two types according to the ink ejection method used. The first type is a thermally-driven inkjet printhead that generates bubbles in ink using a heat source and ejects ink using an expansion force of the bubble. The second type is a piezoelectric inkjet printhead that deforms a piezoelectric element and ejects ink using pressure applied to the ink by deformation of the piezoelectric element.

FIG. 1 illustrates a sectional view of a piezoelectric inkjet printhead. Referring to FIG. 1, a manifold 2, a plurality of restrictors 3, a plurality of pressure chambers 4, and a plurality of nozzles 5, which together constitute ink channels, may be formed inside a channel-forming plate 1. A plurality of piezoelectric actuators 6 may be mounted on the channel-forming plate 1. The manifold 2 is a passage for supplying ink flowing from an ink storage region (not shown) to each of the plurality of pressure chambers 4, and the restrictors 3 are passages through which ink flows from the manifold 2 to the pressure chambers 16. The pressure chambers 4 are filled with ink to be ejected. Each of the pressure chambers 16 changes its volume as a corresponding piezoelectric actuator 6 is driven, thereby creating the pressure change required for ejecting ink, or for drawing ink from the manifold 2.

The channel-forming plate 1 may be manufactured by processing a plurality of thin plates made of, e.g., a ceramic material, metal or a synthetic resin, to form the ink channels, and then stacking these plates. The piezoelectric actuators 6 are provided on each of the pressure chambers 4 and have a stacked structure that includes a piezoelectric layer and an electrode for applying a voltage to the piezoelectric layer. Portions of the channel-forming plate 1, i.e., the portions that constitute upper walls of each of the pressure chambers 4, serve as vibration plates 1*a* that are deformed by driving the corresponding piezoelectric actuator 6.

When the piezoelectric inkjet printhead is operated and the vibration plate 1*a* is deformed by the piezoelectric actuator 6, the volume of the pressure chamber 4 reduces, which generates a pressure change in the pressure chamber 4, so that ink contained in the pressure chamber 4 is ejected to the outside through the nozzle 5. Subsequently, when the vibration plate 1*a* is restored to its original shape by the piezoelectric actuator 6, the volume of the pressure chamber 4 increases, which generates a pressure change in the pressure chamber 4, i.e., a pressure drop, so that ink flows from the manifold 2 into the pressure chamber 4 through the corresponding restrictor 3.

FIG. 2 illustrates an exploded perspective view of another piezoelectric inkjet printhead. Referring to FIG. 2, the piezoelectric inkjet printhead may be formed by stacking and bonding a plurality of thin plates 11 through 16. As illustrated, a first plate 11 having a plurality of nozzles 11*a* for ejecting ink is disposed at the lowermost side of the printhead, a second plate 12 having a manifold 12*a* and ink ejection parts 12*b* is stacked on the first plate 11, and a third plate 13 having ink inflow parts 13*a* and ink ejection parts 13*b* is stacked on the second plate 12. In addition, the third plate 13 may have an ink inlet 17 for the flow of ink to the manifold 12*a* from an ink storage region (not shown).

A fourth plate 14 having ink inflow parts 14*a* and ink ejection parts 14*b* is stacked on the third plate 13, and a fifth plate 15, having a plurality of pressure chambers 15*a* whose ends respectively communicate with the ink inflow parts 14*a* and the ink ejection parts 14*b*, is stacked on the fourth plate 14. The ink inflow parts 13*a* and 14*a* serve as passages through which the ink flows from the manifold 12*a* to the pressure chambers 15*a*, and the ink ejection parts 12*b*, 13*b*, and 14*b* serve as passages through which the ink is ejected from the pressure chambers 15*a* to the nozzles 11*a*. A sixth plate 16 closing the upper portion of the pressure chambers 15*a* is stacked on the fifth plate 15, and drive electrodes 20 and piezoelectric layers 21 that constitute piezoelectric actuators are formed on the sixth plate 16. Therefore, the sixth plate 16 serves as a vibration plate that vibrates when the piezoelectric actuators are driven to change the volume of each of the pressure chambers 15*a* disposed beneath them by elastically deforming the sixth plate 16.

The first through third plates 11, 12 and 13 may be formed by, e.g., etching or press-processing a thin metal plate, and the fourth through sixth plates 14, 15 and 16 may be formed by, e.g., cutting and processing a thin plate of ceramic material. The second plate 12 where the manifold 12*a* is formed may be formed by, e.g., injection molding, by press-processing a thin plastic material or a film-type adhesive, or by screen-printing a paste-type adhesive. The piezoelectric layer 21 formed on the sixth plate 16 may be formed by, e.g., coating a ceramic material, in paste form, and sintering it.

To manufacture the piezoelectric inkjet printhead illustrated in FIG. 2, multiple processes are required to separately process each of a plurality of metal plates and ceramic plates. Further, these plates must be stacked and then bonded using an adhesive. Moreover, the number of plates constituting the printhead of FIG. 2 is relatively large, so the number of processes required for aligning the plates increases, which increases the likelihood of generating an alignment error. When an alignment error is generated, ink does not flow quickly through the ink channels, which reduces the ink ejecting performance of the printhead. In particular, when high density printheads are manufactured in an effort to improve printing resolution, the alignment process requires significant accuracy, which leads to high manufacturing costs.

Since the plurality of plates constituting the printhead are manufactured by different methods using different materials, the manufacturing processes are complicated and bonding between materials of different kinds may be difficult, which reduces product yield. Also, even when the plurality of plates are accurately aligned and bonded during the manufacturing process, an alignment error or deformation may be generated due to a difference in thermal expansion coefficients between materials of different kinds when the temperature the materials change.

FIG. 3 illustrates an exploded perspective view of still another piezoelectric inkjet printhead. Referring to FIG. 3, the inkjet printhead has a structure in which three silicon substrates 30, 40 and 50 are stacked and bonded together. Pressure chambers 32 of a predetermined depth are formed in the lower surface of the upper substrate 30. An ink inlet 31 connected with an ink storage region (not shown) is formed to pass through one side of the upper substrate 30. The pressure chambers 32 are arranged in two columns along both sides of a manifold 41, which is formed in the intermediate substrate 40. Piezoelectric actuators 60 each providing a driving force required for ejecting ink to each of the pressure chambers 32 are formed on the upper surface of the upper substrate 30.

The intermediate substrate 40 has the manifold 41 connected to the ink inlet 31, and a plurality of restrictors 42, each of which is connected with a corresponding pressure chamber 32, are formed along both sides of the manifold 41. Also, each of a plurality of dampers 43 is formed in a position of the intermediate substrate 40 that corresponds to each of the pressure chambers 32. Each of the plurality of dampers 43 is formed to vertically pass through the intermediate substrate 40. Also, nozzles 51, each of which is connected with each of the dampers 43, are formed in the lower substrate 50.

As described above, the inkjet printhead illustrated in FIG. 3 has a structure in which only three silicon substrates 30, 40 and 50 are stacked. Therefore, the inkjet printhead of FIG. 3 has a reduced number of substrates compared with the inkjet printhead of FIG. 2, and thus the manufacturing process thereof is relatively simple. Accordingly, alignment errors arising during the process of stacking the three substrates may be reduced. However, the manufacturing cost of the printhead of FIG. 3 is still high, and the performance thereof at high driving frequencies for rapid printing may not be satisfactory.

SUMMARY OF THE INVENTION

The present invention is therefore directed to a piezoelectric inkjet printhead and a method of manufacturing the same, which substantially overcomes one or more of the problems due to the limitations and disadvantages of the related art.

It is therefore a feature of an embodiment of the present invention to provide a piezoelectric inkjet printhead formed of two substrates.

It is therefore another feature of an embodiment of the present invention to provide a piezoelectric inkjet printhead having an upper substrate formed of a silicon-on-insulator wafer.

It is therefore yet another feature of an embodiment of the present invention to provide a method of manufacturing a piezoelectric inkjet printhead that involves a reduced number of steps and provides for enhanced alignment of the substrates constituting the printhead.

At least one of the above and other features and advantages of the present invention may be realized by providing a piezoelectric inkjet printhead including an upper substrate having an ink inlet, a manifold connected with the ink inlet, and a plurality of pressure chambers arranged along at least one side of the manifold, wherein the ink inlet passes through the upper substrate, and the manifold and the pressure chambers are formed in a lower surface of the upper substrate, a lower substrate disposed directly adjacent the upper substrate, the lower substrate having a plurality of restrictors each connecting the manifold with one end of each of the pressure chambers, and a plurality of nozzles each being formed in a position of the lower substrate that corresponds to the other end of each of the pressure chambers to vertically pass through the lower substrate, wherein the plurality of restrictors are formed in an upper surface of the lower substrate, and a plurality of piezoelectric actuators, the piezoelectric actuators formed on the upper substrate and corresponding to the pressure chambers.

Each of the upper substrate and the lower substrate may be a silicon substrate, the upper substrate may be stacked on the lower substrate, and the upper substrate may include a silicon-on-insulator wafer including a first silicon layer, an intermediate oxide layer, and a second silicon layer sequentially stacked on each other. The manifold and the plurality of pressure chambers may be formed in the first silicon layer, and the second silicon layer may serve as a vibration plate to be deformed by the piezoelectric actuator. A depth of each of the pressure chambers may be substantially the same as a thickness of the first silicon layer, and a depth of the manifold may be less than that of each of the pressure chambers. The manifold may extend in a first direction, and the plurality of pressure chambers may be arranged in two columns extending in the first direction, the two columns disposed on opposite sides of the manifold. A partition wall may be formed inside the manifold and extends in the first direction.

One end of each of the restrictors may extend about to the partition wall. Each of the restrictors may include two parts spaced apart from each other, and the two parts may be connected to each other through a connection groove formed to a predetermined depth in a lower surface of the upper substrate. Each piezoelectric actuator may include a lower electrode formed on the upper substrate, a piezoelectric layer formed on the lower electrode, above an upper surface of a corresponding pressure chamber, and an upper electrode formed on the piezoelectric layer. The lower electrode may include two thin metal layers made of Ti and Pt. A silicon oxide layer may be formed as an insulation layer between the upper substrate and the lower electrode. Each of the nozzles may include an ink entering part formed to a predetermined depth from the upper surface of the lower substrate, and an ink ejection part formed in the lower surface of the lower substrate and communicating with the ink entering part. The ink entering part may have a pyramid shape whose cross-section decreases along a direction from the upper surface of the lower substrate to the ink ejection part.

At least one of the above and other features and advantages of the present invention may also be realized by providing a method of manufacturing a piezoelectric inkjet printhead including micromachining an upper substrate to form an ink inlet, a manifold connected with the ink inlet, and a plurality of pressure chambers, micromachining the lower substrate to form a plurality of restrictors each connecting the manifold with one end of each of the pressure chambers, and a plurality of nozzles, stacking the upper substrate on the lower substrate and bonding them to each other, and forming a plurality of piezoelectric actuators on the upper substrate, the piezoelectric actuators corresponding to the pressure chambers.

The micromachining of the upper substrate and the micromachining of the lower substrate may include forming an alignment mark in each of the upper substrate and the lower substrate, the alignment mark being used as an alignment reference during the bonding of the upper substrate and the lower substrate. The micromachining of the upper substrate may include forming the manifold long in one direction and forming the pressure chambers such that the pressure chambers are arranged in two columns, one along each side of the manifold. The micromachining of the upper substrate may further include forming a partition wall disposed inside the manifold and extending in a length direction of the manifold.

The upper and lower substrates may each be single crystal silicon substrates and the upper substrate may be a silicon-on-insulator wafer having a structure in which a first silicon layer, an intermediate oxide layer, and a second silicon layer are sequentially stacked. The micromachining of the upper substrate may include forming the pressure chambers and the ink inlet by etching the first silicon layer using the intermediate oxide layer as an etch-stop layer. The micromachining of the upper substrate may further include forming the manifold to a depth smaller than that of each of the pressure chambers. The micromachining of the upper substrate may further include forming a silicon oxide layer on each of an upper surface and a lower surface of the upper substrate, patterning the silicon oxide layer to form a first opening for forming the manifold, patterning the silicon oxide layer to form second openings for forming the pressure chambers and the ink inlet, initially etching the lower surface of the upper substrate to a predetermined depth through the second openings, and secondarily etching the lower surface of the upper substrate through the first opening and the second openings until the intermediate oxide layer is exposed.

The micromachining of the upper substrate may further include forming the manifold to the same depth as that of each of the pressure chambers. The micromachining of the upper substrate may further include forming a silicon oxide layer on each of an upper surface and a lower surface of the upper substrate, patterning the silicon oxide layer formed on the lower surface of the upper substrate to form openings for the manifold, the pressure chambers, and the ink inlet, and etching the lower surface of the upper substrate through the openings until the intermediate oxide layer is exposed. The etching of the upper substrate may include etching the upper substrate using reactive ion etching with inductively coupled plasma. The ink inlet may be formed in the lower surface of the upper substrate to pass through the upper substrate after the forming of the piezoelectric actuator.

The micromachining of the lower substrate may include forming each of the restrictors by etching the upper surface of the lower substrate to a predetermined depth. Each of the restrictors may be divided into two parts spaced apart from each other. In the micromachining of the lower substrate, each of the nozzles may include an ink entering part formed to a predetermined depth from the upper surface of the lower substrate, and an ink ejection part formed in the lower surface of the lower substrate and communicating with the ink entering part. The ink entering part may be formed by anisotropic wet etching the upper surface of the lower substrate, such that the ink entering part substantially has a pyramid shape whose cross-section decreases along a direction from the upper surface of the lower substrate to the ink ejection part. The ink ejection part may be formed by dry etching the lower surface of the lower substrate such that the ink ejection part communicates with the ink entering part. The bonding of the upper substrate and the lower substrate may include bonding the upper substrate and the lower substrate using silicon direct bonding.

The forming of the piezoelectric actuator may include forming a lower electrode on the upper substrate, forming a piezoelectric layer on the lower electrode, and forming an upper electrode on the piezoelectric layer. The lower electrode may be formed by sputtering Ti and Pt to a predetermined thickness on the upper substrate. The piezoelectric layer may be formed by coating a piezoelectric material in paste form on regions of the lower electrode that correspond to each of the pressure chambers, and sintering the piezoelectric material.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
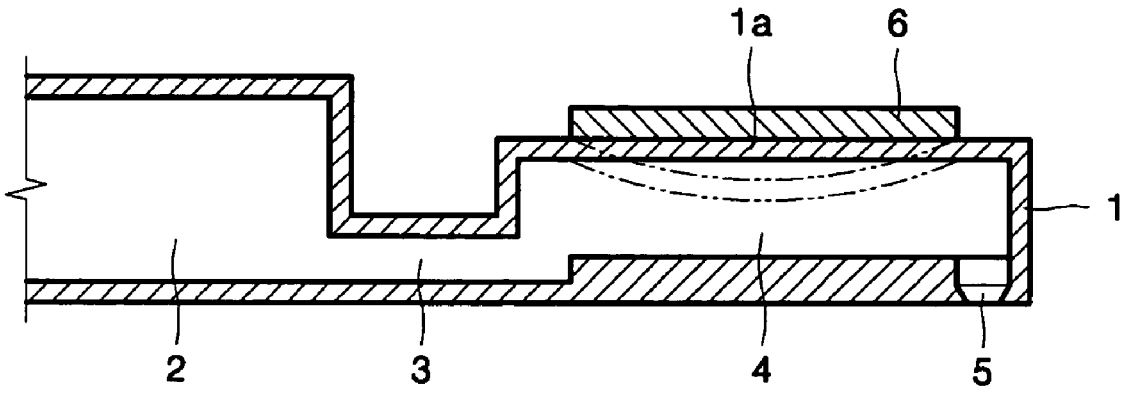
FIG. 1 (PRIOR ART)
FIG. 1 illustrates a sectional view of a piezoelectric inkjet printhead.
Figure 2:
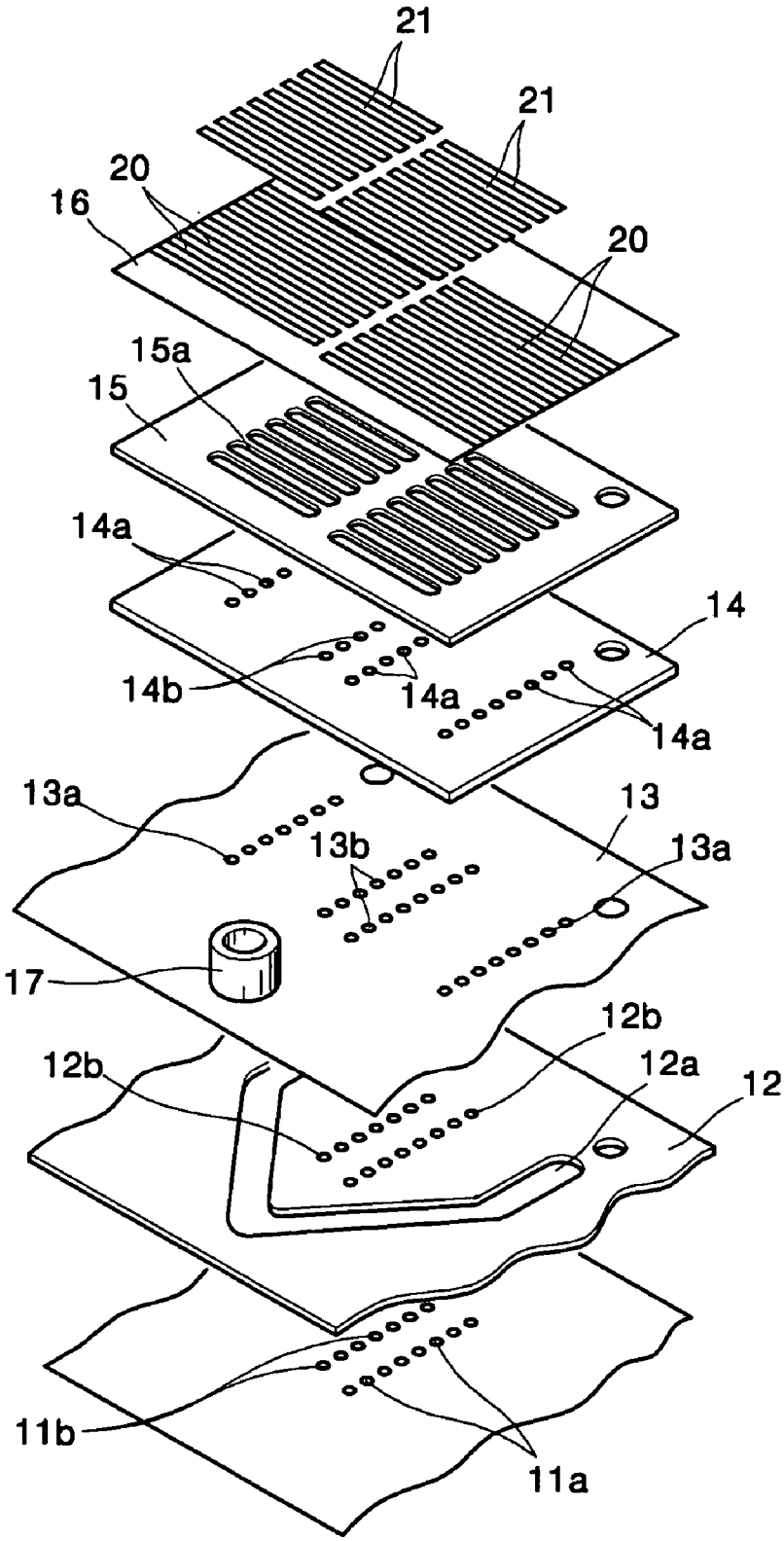
FIG. 2 (PRIOR ART)
FIG. 2 illustrates an exploded perspective view of another piezoelectric inkjet printhead.

Korean Patent Application No. 10-2005-0004454, filed on Jan. 18, 2005, in the Korean Intellectual Property Office, and entitled: "Piezoelectric Inkjet Printhead and Method of Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

According to the present invention, a piezoelectric inkjet printhead, and a method of manufacturing the same, may have the following features. First, the piezoelectric inkjet printhead according to the present invention may be realized using two silicon substrates. Thus, the manufacturing method thereof may be simplified, and yields may be increased while manufacturing costs are reduced. Second, the piezoelectric inkjet printhead according to the present invention may provide stable ink ejection performance even at high driving frequencies. Therefore, the piezoelectric inkjet printhead, and the method of manufacturing the same, may be suitable for printers having rapid printing speeds.

Figure 4:
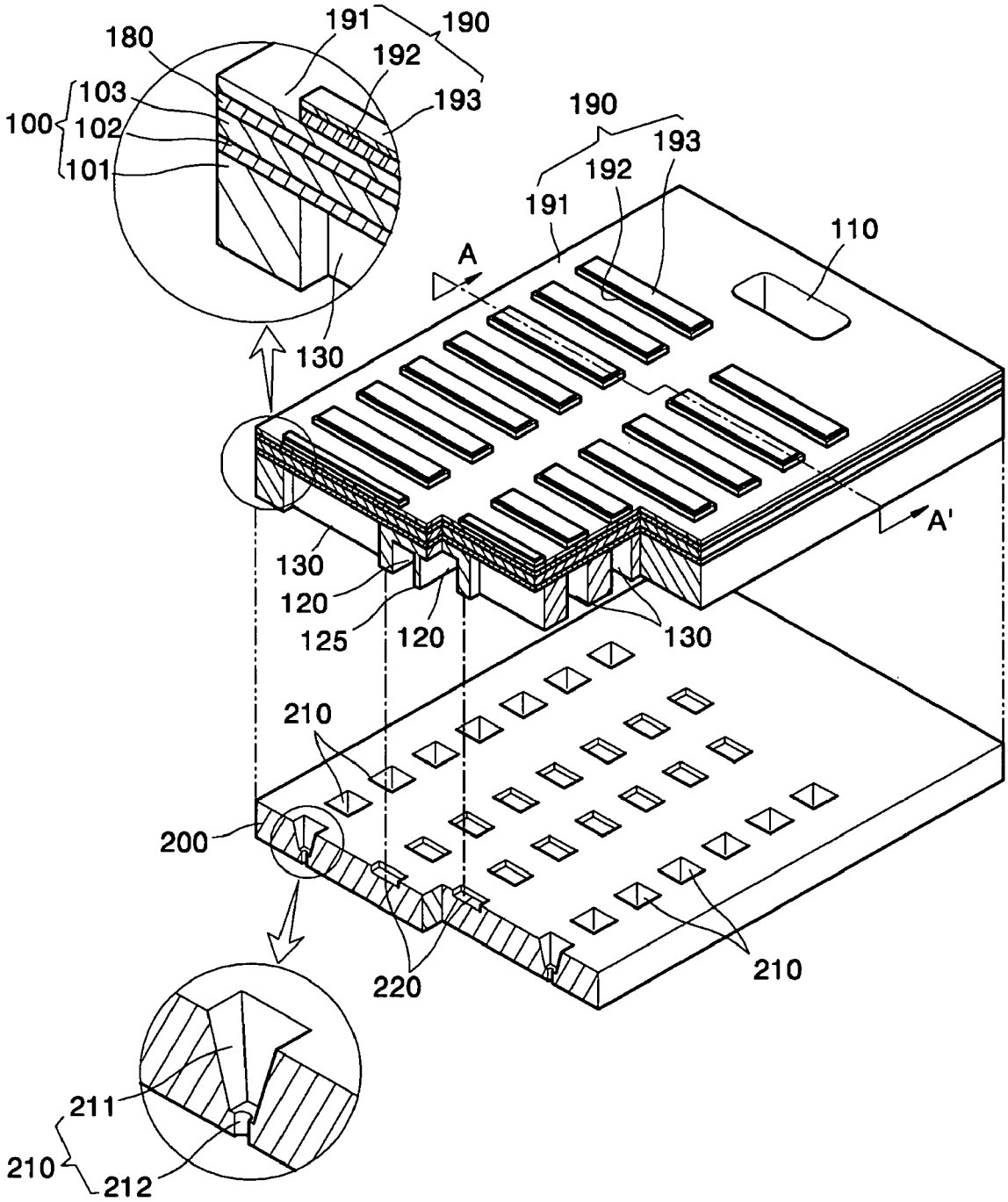
FIG. 4 illustrates a partial exploded perspective view of a piezoelectric inkjet printhead according to an embodiment of the present invention.
Figure 5:
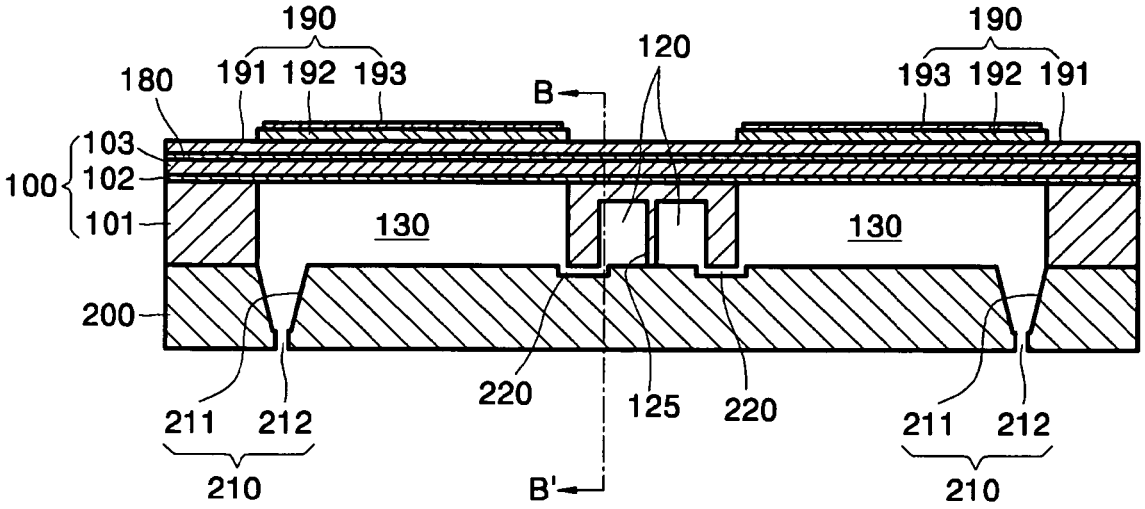
FIG. 5 illustrates a vertical sectional view taken along line A-A' of FIG. 4.
Figure 6:
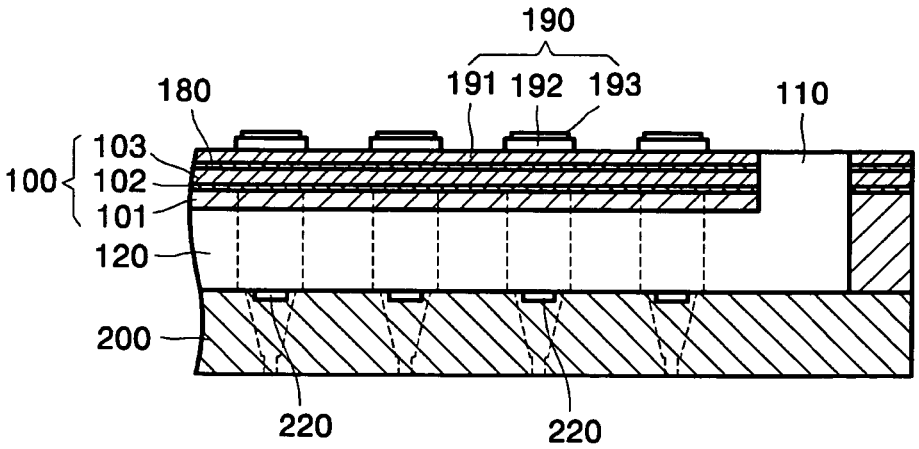
FIG. 6 illustrates a vertical sectional view taken along line B-B' of FIG. 5.

FIG. 4 illustrates a partial exploded perspective view of a piezoelectric inkjet printhead according to an embodiment of the present invention, FIG. 5 illustrates a vertical sectional view taken along line A-A' of FIG. 4, and FIG. 6 illustrates a vertical sectional view taken along line B-B' of FIG. 5.

Referring to FIGS. 4-6, a piezoelectric inkjet printhead according to the present invention may be formed by bonding two substrates, e.g., an upper substrate 100 and a lower substrate 200. Each of the upper substrate 100 and the lower substrate 200 may have an ink channel therein, and a piezoelectric actuator 190, to generate a driving force for ejecting ink, may be provided on the upper surface of the upper substrate 100.

Each of the two substrates 100 and 200 may be formed of, e.g., a single crystal silicon wafer. The use of single crystal silicon wafers helps to more precisely and easily form elements constituting the ink channels in the two substrates 100 and 200 using micromachining technology, e.g., photolithography, etching, etc.

The ink channel may include an ink inlet 110, through which ink from an ink storage region (not shown) flows in, a plurality of pressure chambers 130, which fill with ink that is to be ejected and which generate a pressure change required for ejecting ink, a manifold 120, which is a common channel supplying the ink flowing from the ink inlet 110 to the pressure chambers 130, a plurality of restrictors 220, each being an individual channel that supplies ink from the manifold 120 to a corresponding pressure chamber 130; and a plurality of nozzles 210, each ejecting ink from each of the pressure chambers 130. The elements constituting the ink channel may be distributed in the two substrates 100 and 200.

In detail, the ink inlet 110, the manifold 120 and the pressure chambers 130 may be formed in the upper substrate 100. The manifold 120 may be formed to a predetermined depth in the lower surface of the upper substrate 100 and may have a substantially rectangular shape with a long dimension extending in a first direction. The ink inlet 110 may be formed to vertically pass through the upper substrate 100 to connect to one end of the manifold 120. The pressure chambers 130 may be arranged in two columns extending in the first direction and disposed along the two opposing sides of the manifold 120. Alternatively, the pressure chambers 130 may be formed only in one column on one side of the manifold 120. Each of the pressure chambers 130 may be formed at a predetermined depth in the lower surface of the upper substrate 100 and may have a long rectangular shape, with a long dimension extending in the direction of ink flow.

When the pressure chambers 130 are arranged in two columns on opposing sides of the manifold 120, a partition wall 125 dividing the manifold into right and left may be formed to extend in the length direction of the manifold 120 inside of the manifold 120. Thus, cross-talk between the pressure chambers 130 arranged on opposing sides of the manifold 120 may be reduced or prevented by the partition wall 125.

The upper substrate 100 may be formed of single crystal silicon widely of the type used for manufacturing semiconductor integrated circuits (IC). The upper substrate 100 may be formed of a silicon-n-insulator (SOI) wafer. The SOI wafer may have a structure in which a first silicon layer 101, an intermediate oxide layer 102 formed on the first silicon layer 101, and a second silicon layer 103, bonded on the intermediate oxide layer 102, are sequentially stacked on each other. The first silicon layer 101 may be formed of single crystal silicon and may have a thickness of hundreds of μm, e.g., a thickness of about 210 μm. The intermediate oxide layer 102 may be formed by oxidizing the surface of the first silicon layer 101 and may have a thickness of, e.g., about 2 μm. The second silicon layer 103 may be also formed of single crystal silicon and may have a thickness of several μm through tens of μm, e.g., a thickness of about 13 μm.

The SOI wafer may be used for the upper substrate 100 in order to accurately control the depth of the pressure chambers 130. That is, since the intermediate oxide layer 102 may serve as an etch-stop layer during the forming of the pressure chambers 130, it is possible to control the depth of the pressure chambers 130 by controlling the thickness of the first silicon layer 101. Also, portions of the second silicon layer 103 may constitute the upper walls (i.e., the ceilings) of the pressure chambers 130. In these portions of the second silicon layer 103, the second silicon layer 103 may be deformed by driving a piezoelectric actuator 190 formed thereon. Thus, these portions of the second silicon layer 103 may serve as vibration plates that change the volume of the pressure chambers 130. The thickness of the vibration plate may be determined by the thickness of the second silicon layer 103, as will be described in detail below.

The manifold 120 may be formed to a depth that is less than the depth of the pressure chambers 130. Thus, the region of the upper substrate 100 located above the manifold 120 may have a greater thickness than the regions of the upper substrate 100 which overlie the pressure chambers 130. By forming the manifold to a lesser depth, the region of the upper substrate 100 overlying the manifold 120 may be formed with a thickness that enhances the strength of the upper substrate 100. This added strength may be desirable where a long manifold 120 would otherwise lessen the strength of the printhead.

The manifold 120 may, alternatively, be formed to the same depth as the depth of the pressure chambers 130. Thus, the manufacturing of the pressure chambers 130 and the manifold 120 may be simplified. If, by manufacturing the pressure chambers 130 and the manifold 120 in this way, the thickness of the portion of the upper substrate 100 overlying the manifold 120 is not sufficient, the thickness of the second silicon layer 103 of the upper substrate 100 may be made thicker to compensate. In this case, the regions of the second silicon layer 103 that constitute the vibration plates on the pressure chambers 130 may be adjusted to an appropriate thickness by forming grooves (not shown) to a predetermined depth in the upper surface of the second silicon layer 103, the grooves located on the pressure chambers 130, and forming piezoelectric actuators 190 in the grooves.

The piezoelectric actuator 190 may be formed on the upper substrate 100. A silicon oxide layer 180 may be formed between the upper substrate 100 and the piezoelectric actuator 190. The silicon oxide layer 180 may suppress diffusion between the upper substrate 100 and the piezoelectric actuator 190, control thermal stress, and serve as an insulation layer. The piezoelectric actuator 190 may include a lower electrode 191 serving as a common electrode, a piezoelectric layer 192 changing its shape when a voltage is applied thereto, and an upper electrode 193 serving as a drive electrode. The lower electrode 191 may be formed on an entire surface of the silicon oxide layer 180 and may be, e.g., one conductive metal material layer, or two thin metal layers of Ti and Pt. The lower electrode 191 may serve as a diffusion barrier layer preventing inter-diffusion between the piezoelectric layer 192 and the upper substrate 100, as well as serving as a common electrode.

The piezoelectric layer 192 may be formed on the lower electrode 191 and arranged on each of the pressure chambers 130. The piezoelectric layer 192 may be formed of a piezoelectric material, e.g., a PZT ceramic material. The piezoelectric layer 192 is deformed when a voltage is applied, and deforms the second silicon layer 103 (i.e., the vibration plate) of the upper substrate 100 that constitutes the upper wall of the pressure chambers 130. The upper electrode 193 may be formed on the piezoelectric layer 192 to serve as a drive electrode applying a voltage to the piezoelectric layer 192.

Regarding the lower substrate 200, a plurality of restrictors 220 and a plurality of nozzles 210 may be formed in the lower substrate 200. Each restrictor 220 may be an individual channel connecting the manifold 120 with one end of a corresponding pressure chamber 130. That is, since the upper substrate 100 does not include a channel between the manifold 120 and the pressure chambers 130, each pressure chamber 130 may have a corresponding restrictor 220 disposed opposite thereto in the lower substrate 200, each restrictor coupling one end of the corresponding pressure chamber 130 to the manifold 120. The lower substrate 200 may be formed of a single crystal silicon wafer of the type widely used in manufacturing semiconductor integrated circuits and may have a thickness of hundreds of μm, e.g., a thickness of about 245 μm.

Each of the restrictors 220 may be formed to a predetermined depth, e.g., a depth of 20-40 μm, from the upper surface of the lower substrate 200. One end of each restrictor 220 may be connected to the manifold 120 and the other thereof may be connected to the corresponding pressure chamber 130. Each restrictor 220 may supply an appropriate amount of ink from the manifold 120 to the pressure chamber 130, and may suppress ink flowing backward from the pressure chamber 130 to the manifold 120 during ink ejection.

Each nozzle 210 may be formed in the lower substrate 200 in a position that corresponds to an end of the corresponding pressure chamber 130, and may pass vertically through the lower substrate 200. Each nozzle 210 may include an ink entering part 211 formed in the upper portion of the lower substrate 200, and an ink ejection part 212 formed in the lower portion of the lower substrate 200 and through which ink is ejected. The ink ejection part 212 may be formed in, e.g., the shape of a vertical hole having a predetermined diameter, and the ink entering part 211 may be formed in, e.g., a pyramid shape whose cross-section is gradually reduced along a direction from the pressure chambers 130 to the ink ejection part 212. The ink entering part 211 may have a depth of, e.g., about 230-235 μm.

The two substrates 100 and 200 may be stacked and bonded to each other to form a piezoelectric inkjet printhead according to the present invention, in which an ink channel may be formed by the connection of the ink inlet 110, the manifold 120, the restrictors 220, the pressure chambers 130, and the nozzles 210, in sequence, each of which is formed from the two substrates 100 and 200.

Figure 7A:
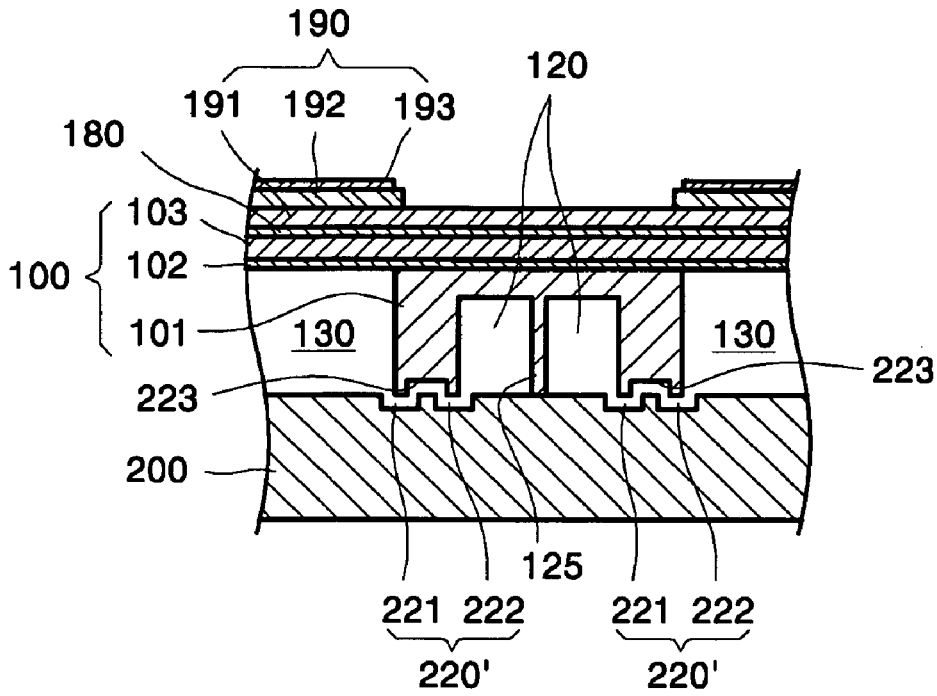
FIGS. 7A and 7B illustrate partial vertical sectional views of modifications of a restrictor illustrated in FIG. 5.
Figure 7B:
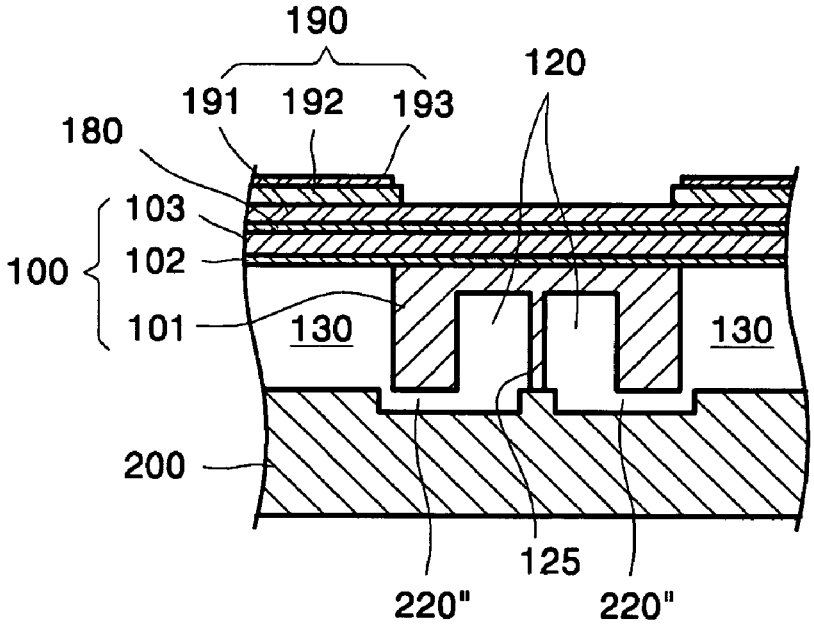

FIGS. 7A and 7B illustrate partial vertical sectional views of modifications of the restrictor illustrated in FIG. 5. Referring to FIG. 7A, restrictors 220' may be formed to a predetermined depth from the upper surface of the lower substrate 200, and may include two parts 221 and 222 spaced apart from each other. An ink flow path or channel between these two parts 221 and 222 may be formed via a connection groove 223 that is formed at a predetermined depth in the lower surface of the upper substrate 100. That is, ink may flow from the manifold 120 into the part 222, then into the connection groove 223, then through the part 221 into the pressure chamber 130. The restrictors 220' may be particularly effective in reducing or preventing back flow of ink from the pressure chamber 130 to the manifold 120 during ink ejection.

Referring to FIG. 7B, the restrictors 220" may also be formed long and deep in comparison with the restrictors 220 illustrated in FIG. 5. That is, one end of each of the restrictors 220" may have a shape that extends to substantially adjoin the partition wall 125, so that a portion of the restrictors 220" that overlaps with the manifold 120 is increased. The restrictors 220" may be particularly effective in increasing the amount of ink supplied from the manifold 120 to the pressure chambers 130.

An operation of the piezoelectric inkjet printhead according to the present invention will now be described. Ink that has flowed from the ink storage region (not shown) into the manifold 120 through the ink inlet 110 is supplied to each of the pressure chambers 130 through the plurality of restrictors 220, 220' or 220". When a voltage is applied to the piezoelectric layer 192 through the upper electrode 193 of the piezoelectric actuator 190 and the pressure chambers 130 are filled with ink, the piezoelectric layer 192 is deformed, and so the second silicon layer 103 of the upper substrate 100, which serves as a vibration plate, is warped downward. When the second silicon layer 103 is warped, the volume of the corresponding pressure chamber 130 reduces, which increases the pressure of the pressure chamber 130, so that ink contained in the pressure chamber 130 is ejected to the outside through the corresponding nozzle 210.

Subsequently, when the voltage that had been applied to the piezoelectric layer 192 of the piezoelectric actuator 190 is suspended, the piezoelectric layer 192 is restored to its original, undeformed shape, and the second silicon layer 103 serving as a vibration plate is also restored to its original, undeformed shape, so that the volume of the pressure chamber 130 increases. Pressure reduction in the pressure chamber, caused by the volume increase, and surface tension, caused by a meniscus of ink formed within the nozzles 210, cause ink to flow from the manifold 120 into the pressure chambers 130 through the restrictors 220, 220' and 220".

Figure 8A:
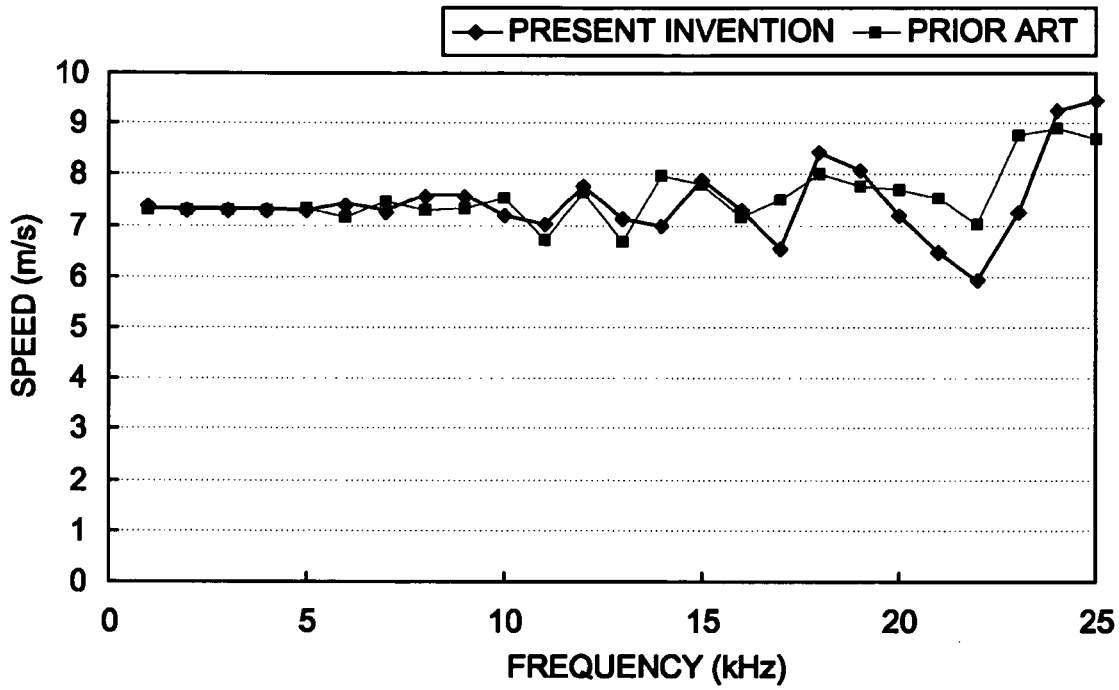
FIG. 8A illustrates a graph of ink ejection speed versus driving frequency, comparing a piezoelectric printhead of the present invention with a conventional piezoelectric printhead.
Figure 8B:
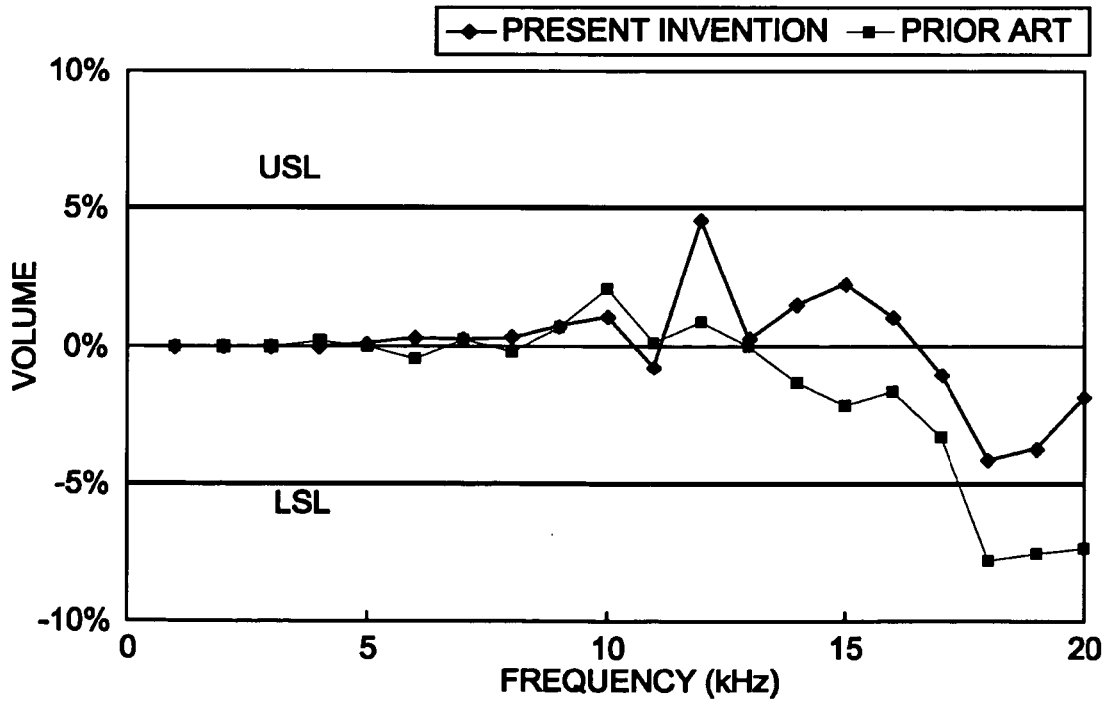
FIG. 8B illustrates a graph of ink droplet volume versus driving frequency, comparing a piezoelectric printhead of the present invention with a conventional piezoelectric printhead.

FIG. 8A illustrates a graph of ink ejection speed versus driving frequency, comparing a piezoelectric printhead of the present invention with a conventional piezoelectric printhead, and FIG. 8B illustrates a graph of ink droplet volume versus driving frequency, comparing a piezoelectric printhead of the present invention with a conventional piezoelectric printhead. Referring to FIG. 8A, there may almost no difference in the ink ejection speed of the piezoelectric inkjet printhead of the present invention and the conventional piezoelectric inkjet printhead of FIG. 3 as the driving frequency changes. That is, the average ink ejection speed of the piezoelectric inkjet printhead of the present invention may be about 7.32 m/s, and the average ink ejection speed of the piezoelectric inkjet printhead of FIG. 3 may be about 7.29 m/s.

Figure 3:
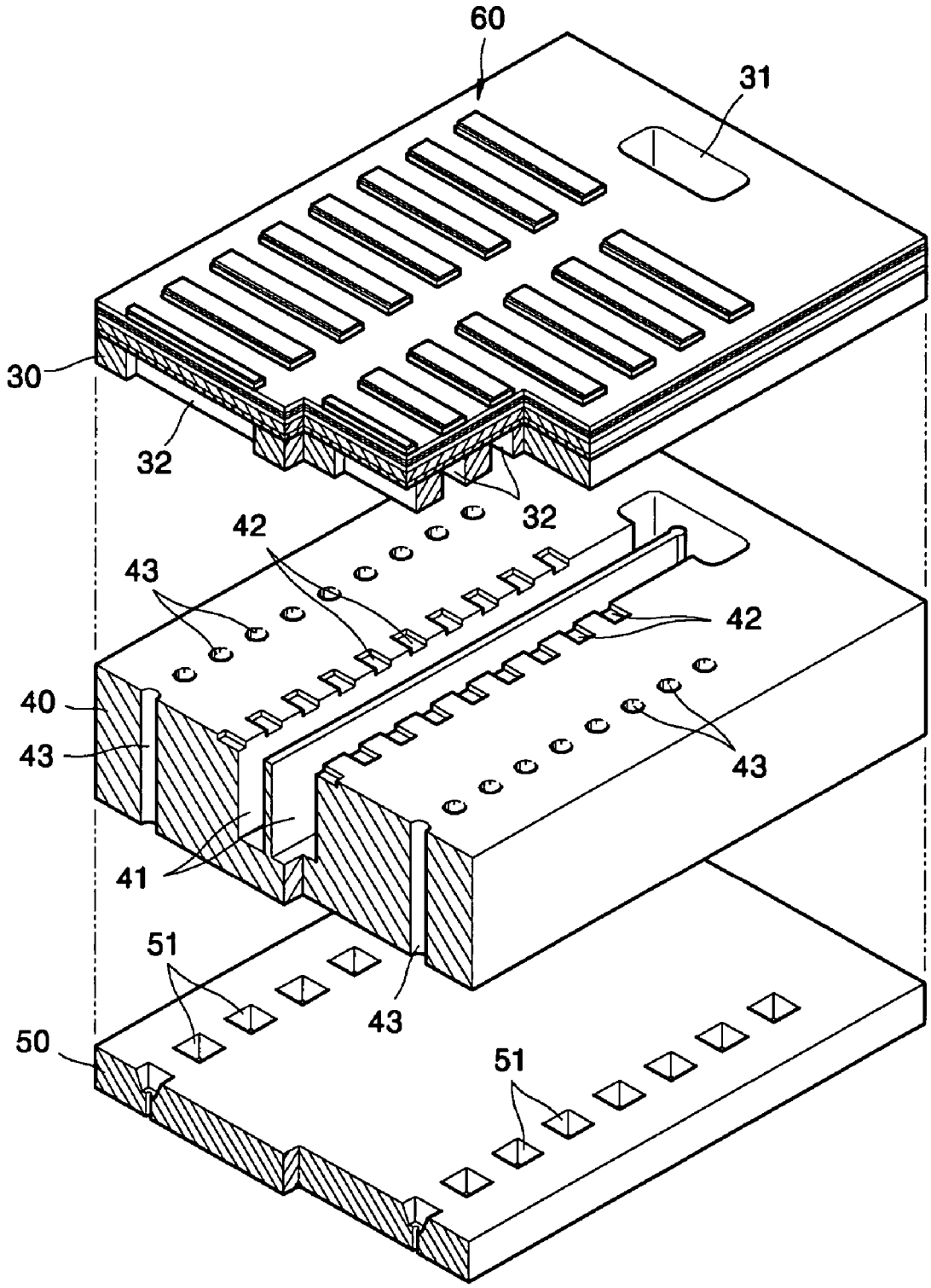
FIG. 3 (PRIOR ART)
FIG. 3 illustrates an exploded perspective view of still another piezoelectric inkjet printhead.

Referring to FIG. 8B, according to the conventional piezoelectric inkjet printhead of FIG. 3, when the driving frequency exceeds about 17 kHz, the ink droplet volume drastically reduces and crosses the lower limit. In contrast, with the piezoelectric inkjet printhead according to the present invention, even when the driving frequency is about 20 kHz, the ink droplet volume is maintained in a range between an upper specification limit (USL) of 5% and a lower specification limit (LSL) of 5%. Ultimately, at a driving frequency of 23.02 kHz, the ink droplet volume may cross the LSL.

A method of manufacturing a piezoelectric inkjet printhead according to the present invention will now be described. First, the method will be generally described, after which further details will be described. Generally, an upper substrate and the lower substrate, in which elements constituting an ink channel are formed, may each be manufactured. Subsequently, the two manufactured substrates may be stacked and bonded to each other, and, finally, a piezoelectric actuator may be formed on the upper substrate, so that the piezoelectric inkjet printhead according to the present invention is completed. Manufacturing the upper and lower substrates may be performed in any order. That is, the lower substrate may be manufactured first, or the two substrates may be manufactured simultaneously. The manufacturing method will be described in the order of manufacturing the upper substrate first, and then the lower substrate.

Figure 9A:
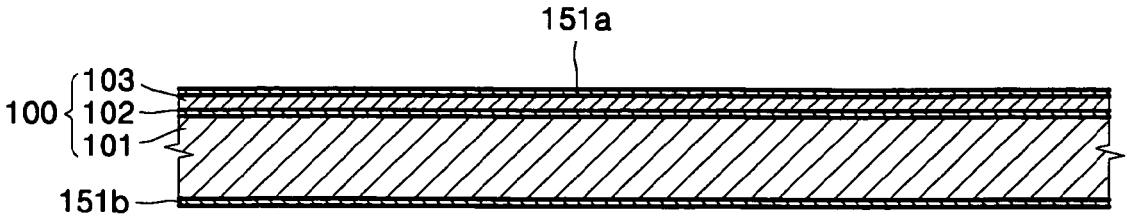
FIGS. 9A-9C illustrate sectional views of stages of forming an alignment mark on a upper surface of a upper substrate in a method of manufacturing the piezoelectric inkjet printhead of FIG. 4, according to an embodiment of the present invention.
Figure 9B:
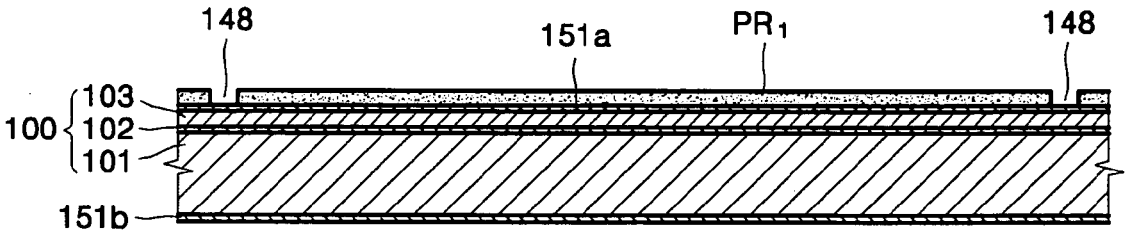
Figure 9C:
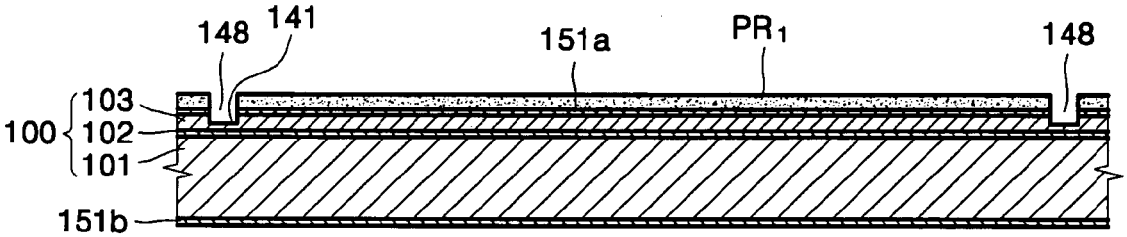

FIGS. 9A-9C illustrate sectional views of stages of forming an alignment mark on a upper surface of the upper substrate in a method of manufacturing the piezoelectric inkjet printhead of FIG. 4, according to an embodiment of the present invention. Referring to FIG. 9A, the upper substrate 100 may be, e.g., a single crystal silicon substrate of the type widely used for manufacturing a semiconductor device, which can be effectively used for mass production. If a SOI wafer is used for the upper substrate 100, it may be possible to more accurately form the height of the pressure chambers 130 (see FIG. 4). As described above, the SOI wafer may have a structure in which a first silicon layer 101 has an intermediate oxide layer 102 formed thereon, and a second silicon layer 103 is formed on the intermediate oxide layer 102.

In the upper substrate 100, the first silicon layer 101 may have a thickness of, e.g., about 650 μm, the intermediate oxide layer 102 may have a thickness of, e.g., about 2 μm, and the second silicon layer 103 may have a thickness of about, e.g., 13 μm. The thickness of the first silicon layer 101 may be reduced using chemical-mechanical polishing (CMP). The first silicon layer 101 may be reduced to an appropriate thickness, e.g., a thickness of about 210 μm, depending on the depth of the pressure chambers 130 (see FIG. 5). At this stage, the entire upper substrate 100 may be cleaned. The cleaning of the upper substrate 100 may include an organic cleaning method using acetone or isopropyl alcohol (IPA), an acid cleaning method using sulphuric acid and buffered oxide etchant (BOE), and a standard clean 1 (SC1) cleaning method.

The cleaned upper substrate 100 may be wet/dry-oxidized to form silicon oxide layers 151*a* and 151*b*, each having a thickness of about 5,000-15,000 Å, on the upper and lower surfaces of the upper substrate 100, respectively.

Referring to FIG. 9B, a photoresist PR1 may be coated on the upper surface of the silicon oxide layer 151*a*. The coated photoresist PR1 may be patterned to form an opening 148, intended for forming an alignment mark at an edge portion on the upper surface of the upper substrate 100. The pattering of the photoresist PR1 may be performed using well-known photolithography process such as exposing and developing. Additional photoresist patterning, described below, may be performed in a similar fashion.

Referring to FIG. 9C, a portion of the silicon oxide layer 151*a* exposed through the opening 148 may be etched using the patterned photoresist PR1 as an etch mask, and subsequently, the upper substrate 100 may be etched to a predetermined depth, so that the alignment mark 141 may be formed. The etching of the silicon oxide layer 151*a* may be performed using, e.g., dry etching such as reactive ion etching (RIE), or wet etching using, e.g., BOE. The etching of the upper substrate 100 may be performed through, e.g., dry etching such as RIE using inductive coupled plasma (ICP), or wet etching using, e.g., tetramethyl ammonium hydroxide (TMAH) or potassium hydroxide (KOH) as a silicon etchant. Thus, the alignment mark 141 may be formed in the edge portion of the upper surface of the upper substrate 100, as illustrated in FIG. 9C.

The photoresist PR1 may be removed using the above-described organic cleaning method and/or the acid cleaning method. The photoresist PR1 may be also removed by ashing. As illustrated, the photoresist PR1 is removed after the silicon oxide layer 151*a* and the upper substrate 100 are etched. However, the silicon oxide layer 511*a* may be etched using the photoresist PR1 as an etch mask and then the photoresist PR1 may be removed. The upper substrate 100 may then be etched using the silicon oxide layer 151*a* as an etch mask. The methods of removing the photoresist PR1 may be also used for removing other photoresists described below.

Figure 10A:
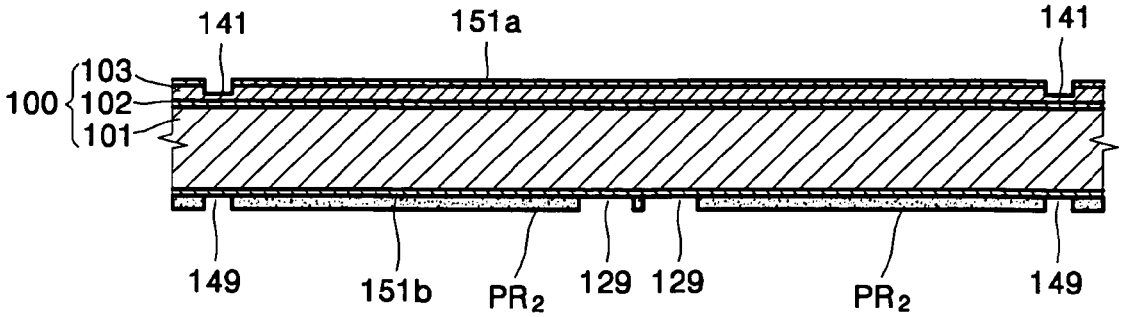
FIGS. 10A-10G illustrate sectional views of stages in forming an ink inlet, a manifold, and pressure chambers in the upper substrate in the method of manufacturing the piezoelectric inkjet printhead of FIG. 4, according to an embodiment of the present invention.

FIGS. 10A-10G illustrate sectional views of stages in forming an ink inlet, a manifold, and pressure chambers in the upper substrate in the method of manufacturing the piezoelectric inkjet printhead of FIG. 4, according to an embodiment of the present invention. Referring to FIG. 10A, a photoresist PR2 may be coated on the surface of the silicon oxide layer 151*b* on the lower surface of the upper substrate 100. Subsequently, the photoresist PR2 may be patterned to form an opening 129, which will be used for forming the manifold 120 in the lower surface of the upper substrate 100 (see FIG. 4). To form the partition wall 125 inside the manifold 120 (see FIG. 4), the photoresist PR2 may be allowed to remain in a region where the partition wall is to be formed. Thus, as illustrated in FIG. 10A, the photoresist PR2 remains in the central region of the lower surface of the upper substrate 100, i.e., between the adjacent openings 129 in FIG. 10A.

An opening 149, for forming an alignment mark, may be simultaneously formed in the photoresist PR2 at an edge portion of the lower surface of the upper substrate 100. The location of the opening 149 may correspond to the location of the alignment mark 141.

Figure 10B:
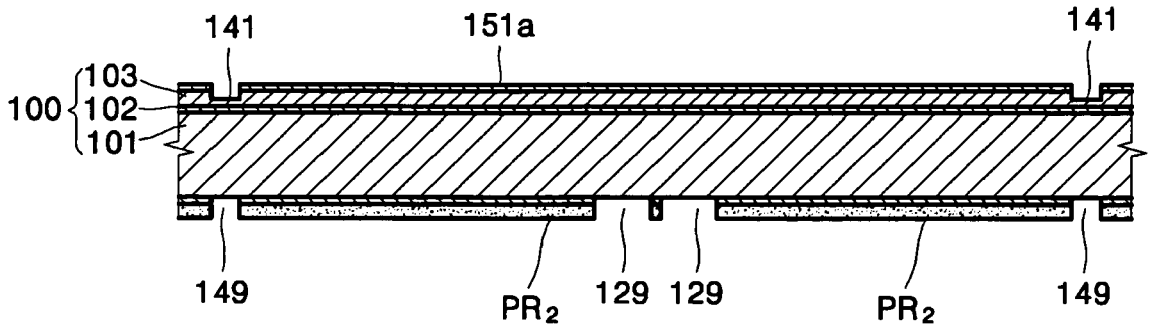

Referring to FIG. 10B, portions of the silicon oxide layer 151*b* exposed through the openings 129 and 149 may be dry-etched using, e.g., RIE or wet-etched using, e.g., BOE, using the photoresist PR2 as an etch mask, so that portions of the lower surface of the upper substrate 100 are exposed. Subsequently, the photoresist PR2 may be removed using, e.g., one of the methods described above.

Figure 10C:
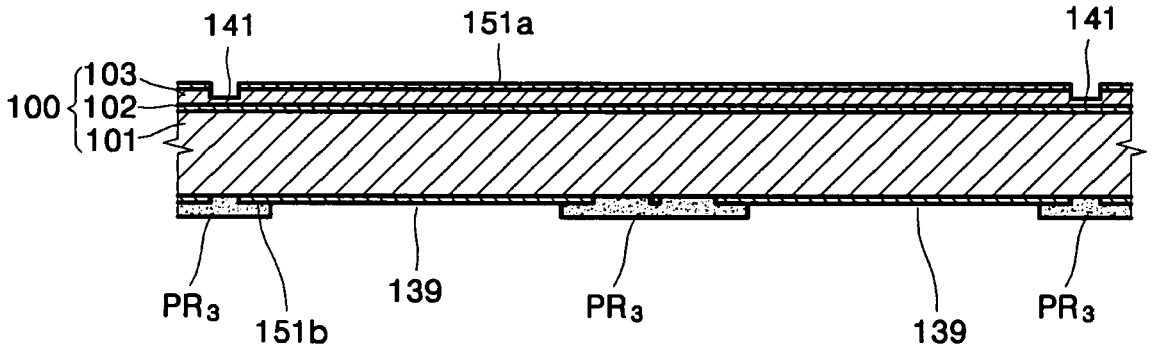

Referring to FIG. 10C, another photoresist PR3 may be coated on the exposed lower surface of the upper substrate 100, and on the surface of the silicon oxide layer 151*b*. The photoresist PR3 may then be patterned to form openings 139, intended for forming the pressure chambers 130 in the lower surface of the upper substrate 100 (see FIG. 4). The photoresist PR3 may also be patterned to form an opening (not shown) for forming the ink inlet 110 (see FIG. 4).

Figure 10D:
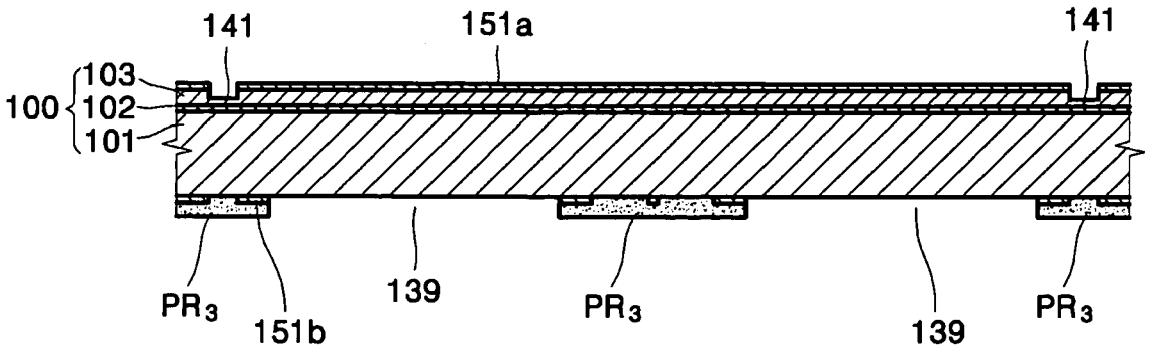
Figure 10E:
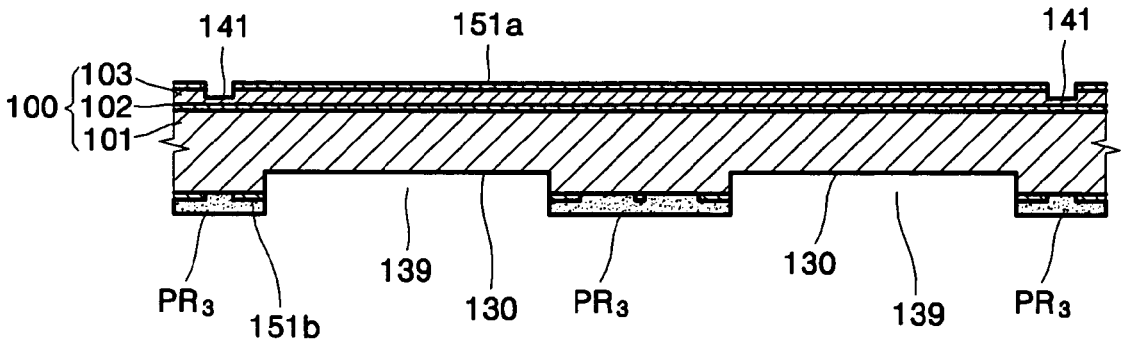
Figure 10F:
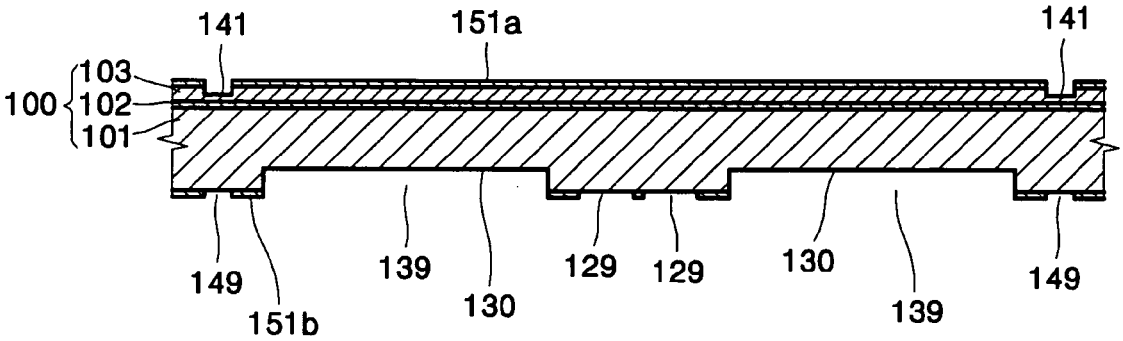

Referring to FIG. 10D, a portion of the silicon oxide layer 151*b* exposed by the opening 139 may be etched by, e.g., the dry or wet etching methods described above, using the photoresist PR3 as an etch mask, so that the lower surface of the upper substrate 100 is partially exposed. Referring to FIG. 10E, the portion of the upper substrate 100 exposed by the opening 139 may be initially etched to a predetermined depth using the photoresist PR3 as an etch mask to form a portion of the pressure chambers 130. A portion of the ink inlet 110 (of FIG. 4) may be simultaneously formed. The initial etching of the upper substrate 100 may be performed using, e.g., a dry etching method such as RIE with ICP.

The depth of the initial etching may be determined based on a desired difference in depths between the pressure chambers 130 and the manifold 120 (see FIG. 4). For example, if the final depth of the pressure chambers 130 is to be 210 μm, and the depth of the manifold 120 is to be 160 μm, the depth of the initial etching may be about 50 μm.

Figure 10G:
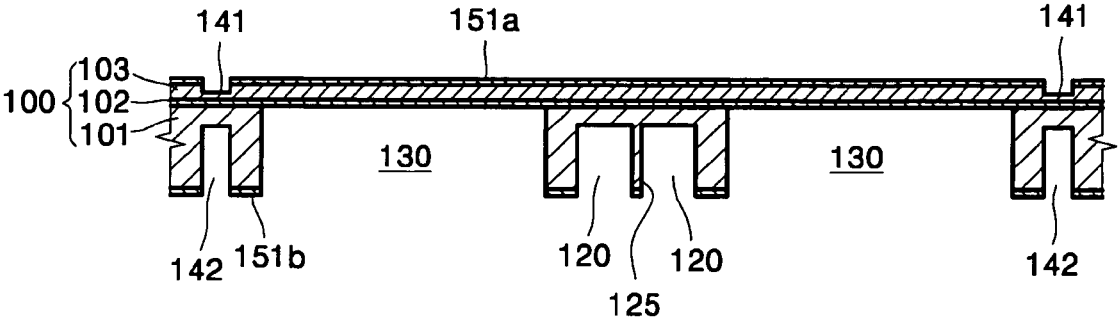

The photoresist PR3 may be removed after the initial etching using, e.g., one of the methods described above, so that the lower surface of the upper substrate 100 is exposed through the opening 129, intended for forming the manifold, and through the opening 149, intended for forming the alignment mark. Referring to FIG. 10G, exposed portions of the lower surface of the upper substrate 100 may be secondarily etched using the silicon oxide layer 151*b* as an etch mask to form the pressure chambers 130 and the manifold 120. The ink inlet 110 (not shown—see FIG. 4) may be simultaneously formed to the same depth as the depth of the pressure chambers 130. An alignment mark 142 may be formed to the same depth as the depth of the manifold 120. Also, a partition wall 125 dividing the manifold 120 into right and left may be formed in the inside of the manifold 120 by allowing the substrate material to remain there. The secondary etching of the upper substrate 100 may be performed using, e.g., a dry etching method such as RIE with ICP. The ink inlet 110 may be post-processed later, as described below, so as to completely vertically pass through and penetrate the upper substrate 100.

The upper substrate 100, in which the ink inlet 110, the manifold 120 and the pressure chambers 130 are formed in the lower surface of the upper substrate, may be fabricated as described above. As illustrated, when a SOI wafer is used as the upper substrate 100, the intermediate oxide layer 102 of the SOI wafer may serve as an etch stop layer, so that only the first silicon layer 101 is etched during the secondary etching. Thus, it may be possible to accurately control the depth of the pressure chambers 130 by controlling the thickness of the first silicon layer 101.

As illustrated, the manifold 120 is formed to a depth that is less than the depth of the pressure chambers 130. However, the present invention is not limited to this example, and other arrangements, such as where the manifold 120 is formed to the same depth as the depth of the pressure chambers 130, are also possible. If the manifold 120 is formed to the same depth as the depth of the pressure chambers 130, the pressure chambers 130 and the manifold 120 may be simultaneously formed, thereby simplifying the manufacturing process. In detail, the opening 139, for forming the pressure chambers 130, and the opening for forming the ink inlet 110 (not shown) may be simultaneously formed when the opening 129 is formed during the operations illustrated in FIGS. 10A and 10B. Subsequently, the lower surface of the upper substrate 100 may be etched through the openings 129 and 139 using, e.g., a dry etch process, until the intermediate oxide layer 102 is exposed. Thus, the ink inlet 110, the manifold 120, and the pressure chambers 130, each having the same depth, may be simultaneously formed using one etching process.

Figure 11A:
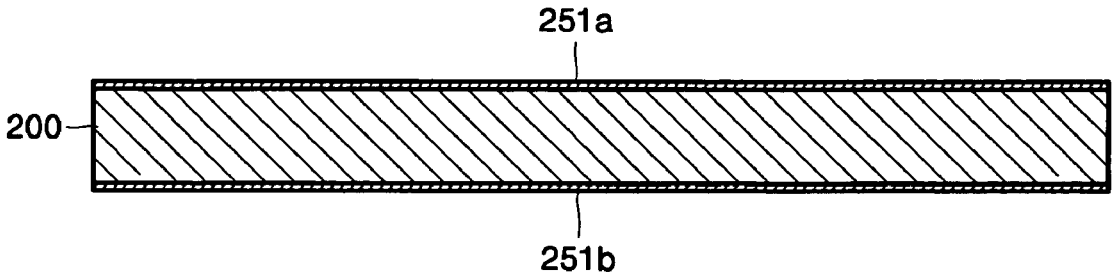
FIGS. 11A-11J illustrate sectional views of stages in forming restrictors and nozzles in a lower substrate in the method of manufacturing the piezoelectric inkjet printhead of FIG. 4, according to an embodiment of the present invention.

FIGS. 11A-11J illustrate sectional views of stages in forming restrictors and nozzles in the lower substrate in the method of manufacturing the piezoelectric inkjet printhead of FIG. 4, according to an embodiment of the present invention. The lower substrate 200 may be, e.g., a single crystal silicon substrate. Referring to FIG. 11A, the lower substrate 200 may be prepared to have a thickness of, e.g., about 650 μm. Subsequently, the lower substrate 200 may be reduced to a thickness of, e.g., about 245 μm using CMP, and then the entire lower substrate 200 may be cleaned. The cleaning of the lower substrate 200 may be performed one or more of the cleaning methods described above, e.g., organic cleaning, the acid cleaning, SC1 cleaning, etc.

The cleaned lower substrate 200 may be wet/dry-oxidized to form silicon oxide layers 251*a* and 251*b*, each having a thickness of about 5,000-15,000 Å, on the upper and lower surfaces of the lower substrate 200, respectively.

Figure 11B:
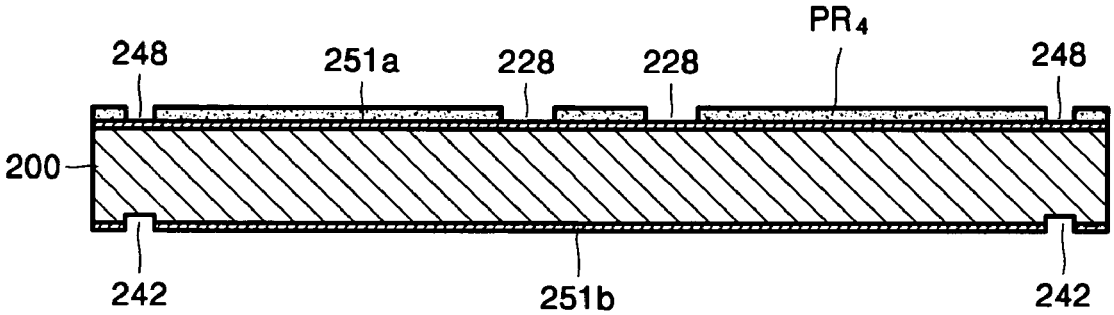

Referring to FIG. 11B, an alignment mark 242 may be formed at an edge portion of the lower surface of the lower substrate 200. The alignment mark 242 may be formed using the operations described above and illustrated in FIGS. 9A-9C.

A photoresist PR4 may be coated on the surface of the silicon oxide layer 251*a*. Next, the photoresist PR4 may be patterned to form an opening 228, for forming the restrictors 220 in the upper surface of the lower substrate 200 (see FIG. 4). An opening 248, for forming an alignment mark at an edge portion of the upper surface of the lower substrate 200, may be simultaneously formed.

To form the restrictors 220' illustrated in FIG. 7A, openings 228, spaced apart from each other, may be formed corresponding to the shape of the restrictors 220'. If a connection groove 223 is to be formed in the lower surface of the upper substrate 100 (see FIG. 7A), the forming of the connection groove 223 may be performed before the operation illustrated in FIG. 10A (not shown). To form the restrictors 220" illustrated in FIG. 7B, the openings 228 may be extended to adjoin the region that corresponds to the partition wall 125 formed in the upper substrate 100.

Figure 11C:
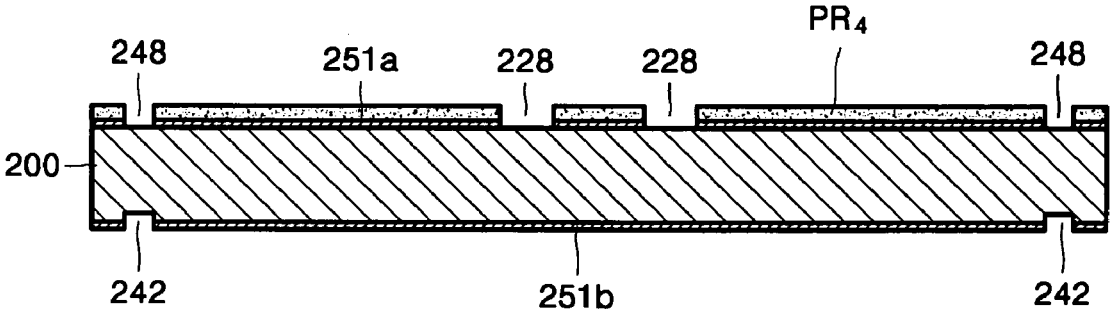

Referring to FIG. 11C, portions of the silicon oxide layer 251*a* exposed through the openings 228 and 248 may be etched using, e.g., dry-etching with RIE or wet etching with BOE, using the photoresist PR4 as an etch mask, so that portions of the upper surface of the lower substrate 200 are exposed. Subsequently, the photoresist PR4 may be removed using, e.g., one of the photoresist removal processes described above.

Figure 11D:
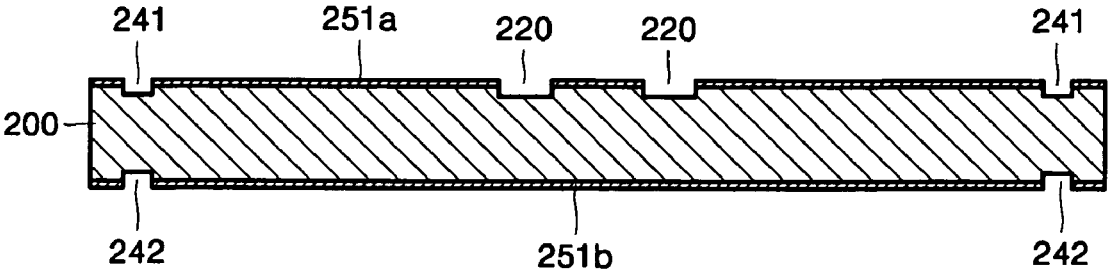

Referring to FIG. 11D, the exposed portions of the upper surface of the lower substrate 200 may be etched to a depth of, e.g., about 20-40 μm, using the silicon oxide layer 251*a* as an etch mask, so that the restrictors 220 and the alignment mark 241 are formed. The etching of the lower substrate 200 may be performed through, e.g., dry etching with RIE/ICP, wet etching using TMAH or KOH, etc. If the upper surface of the lower substrate 200 is dry-etched, the sidewalls of the resistors 220 may be substantially vertically formed, whereas, if a wet etch is used, the sidewalls of the resistors 220 may be obliquely formed.

Figure 11E:
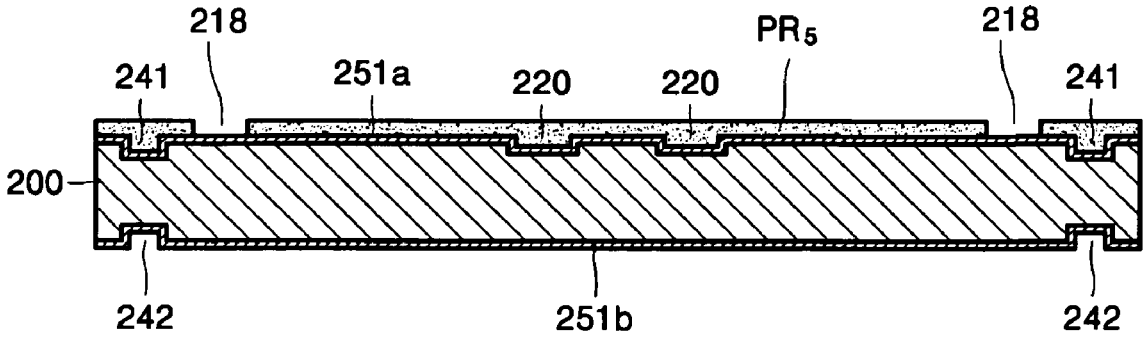

Referring to FIG. 11E, the lower substrate 200 may be cleaned using, e.g., one of the cleaning methods described above, after which it may be wet/dry-oxidized to form silicon oxide layers 251*a* and 251*b*, each having a thickness of about 5,000-6,000 Å, on the upper and lower surfaces of the lower substrate 200, respectively. As illustrated in FIG. 11E, the silicon oxide layers 251*a* and 251*b* may be formed on the insides of the restrictors 220 and the alignment marks 241 and 242.

A photoresist PR5 may be coated on the surface of the silicon oxide layer 251*a* and patterned to form an opening 218, intended for forming the ink entering part 211 of the nozzle 210 in the upper surface of the lower substrate 200 (see FIG. 4).

Figure 11F:
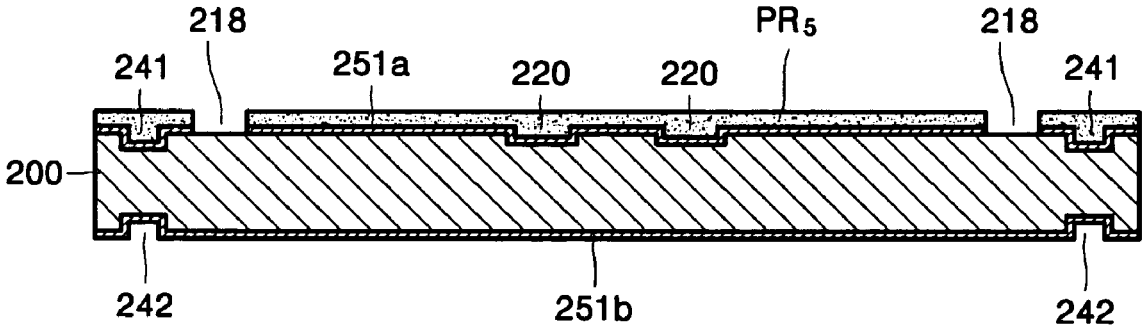

Referring to FIG. 11F, a portion of the silicon oxide layer 251*a* exposed through the opening 218 may be etched using the photoresist PR5 as an etch mask, so that the upper surface of the lower substrate 200 is partially exposed. The etching of the silicon oxide layer 251*a* may be performed using, e.g., dry etching or wet etching, as described above. The photoresist PR5 may then be removed and, after the photoresist PR5 is removed, the lower substrate 200 may be cleaned by, e.g., an acid cleaning method using sulphuric acid and BOE.

Figure 11G:
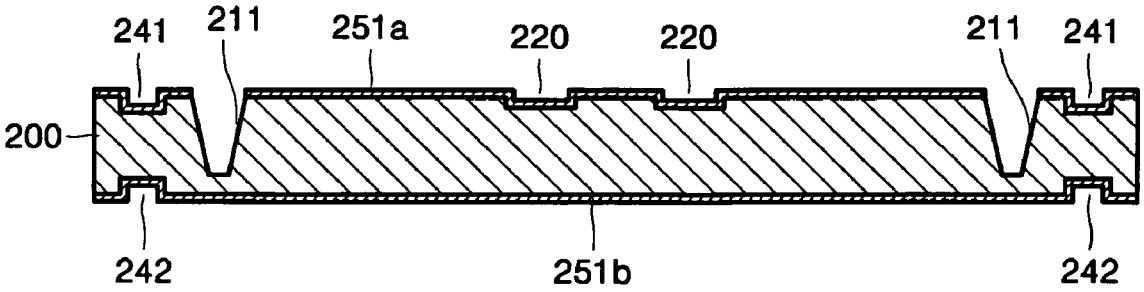

Referring to FIG. 11G, the exposed portion of the lower substrate 200 may be etched to a predetermined depth, e.g., a depth of about 230-235 μm, using the silicon oxide layer 251*a* as an etch mask, so that the ink entering part 211 of each of the nozzles 210 is formed. The etching of the lower substrate 200 may be performed through, e.g., wet etching using TMAH or KOH. A pyramid shape for the ink entering part 211 may be formed using anisotropic wet etching, due to the characteristics of the crystal plane of the lower substrate 200.

Figure 11H:
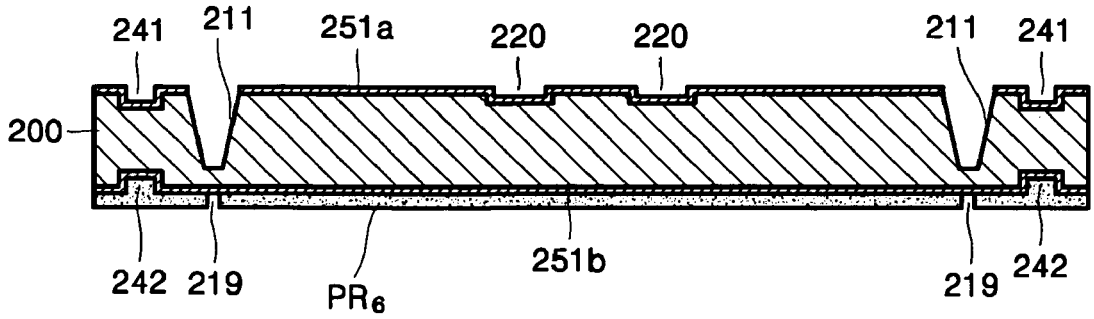
Figure 11I:
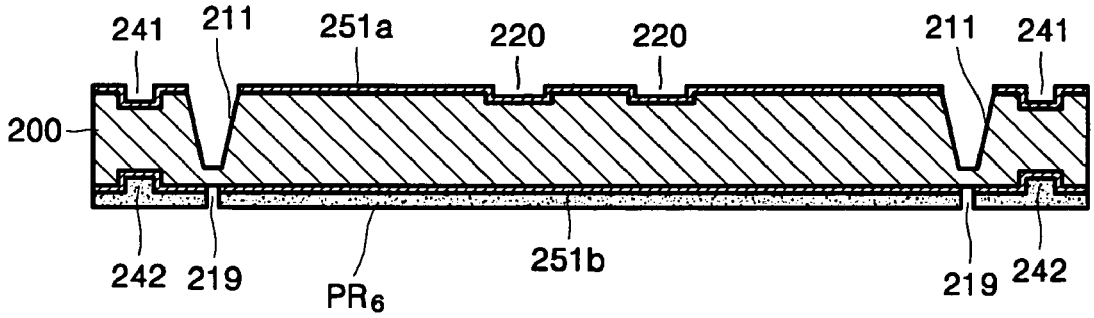
Figure 11J:
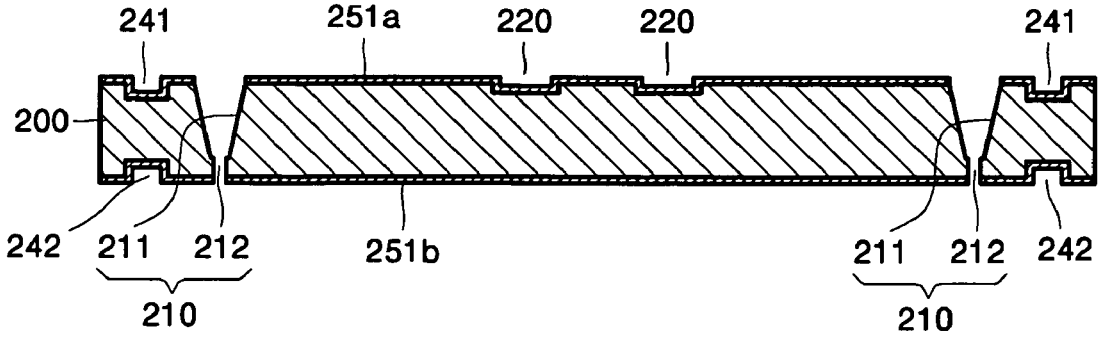

Next, as illustrated in FIG. 11H, a photoresist PR6 may be coated on the surface of the silicon oxide layer 251*b*. The photoresist PR6 may be patterned to form an opening 219, intended for forming the ink ejection part 212 of each of the nozzles in the lower surface of the lower substrate 200 (see FIG. 4). As illustrated in FIG. 11I, a portion of the silicon oxide layer 251*b* exposed through the opening 219 may be etched using, e.g., a wet-etch or dry-etch, and using the photoresist PR6 for an etch mask, so that the lower surface of the lower substrate 200 is partially exposed. The photoresist PR6 may then be removed. As illustrated in FIG. 11J, the exposed portion of the lower substrate 200 may be etched using the silicon oxide layer 251*b* as an etch mask, so that the ink ejection part 212 communicating with the ink entering part 211 is formed. The etching of the lower substrate 200 may be performed using, e.g., dry etching using ICP-RIE.

As described above, the lower substrate 200 may be completed, in which the nozzles 210 are formed to pass through the lower substrate 200, each including the ink entering part 211 and the ink ejection part 212, and in which the restrictors 220 are formed in the upper surface of the lower substrate 200.

Figure 12:
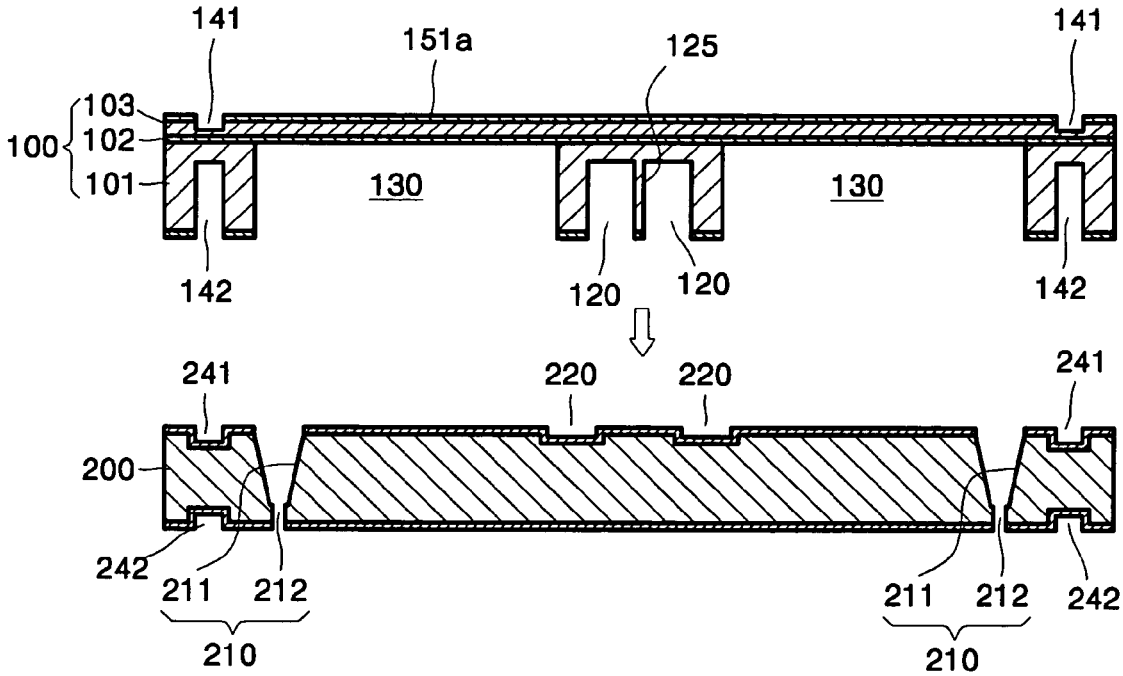
FIG. 12 illustrates a sectional view of a stage in stacking the upper substrate on the lower substrate and bonding them to each other in the method of manufacturing the piezoelectric inkjet printhead of FIG. 4, according to an embodiment of the present invention.

FIG. 12 illustrates a sectional view of a stage in stacking an upper substrate on a lower substrate and bonding them to each other in the method of manufacturing the piezoelectric inkjet printhead of FIG. 4, according to an embodiment of the present invention. Referring to FIG. 12, the upper substrate 100 may be stacked on the lower substrate 200 and the substrates may be bonded to each other. It may be possible to increase the alignment accuracy by using the alignment marks 141, 142, 241 and 242, formed the upper substrate 100 and the lower substrate 200, respectively. The two substrates 100 and 200 may be bonded using, e.g., silicon direct bonding (SDB). When the two substrates 100 and 200 are stacked and bonded to each other, the ink channels for ink flow in the inkjet printhead are all connected.

Figure 13:
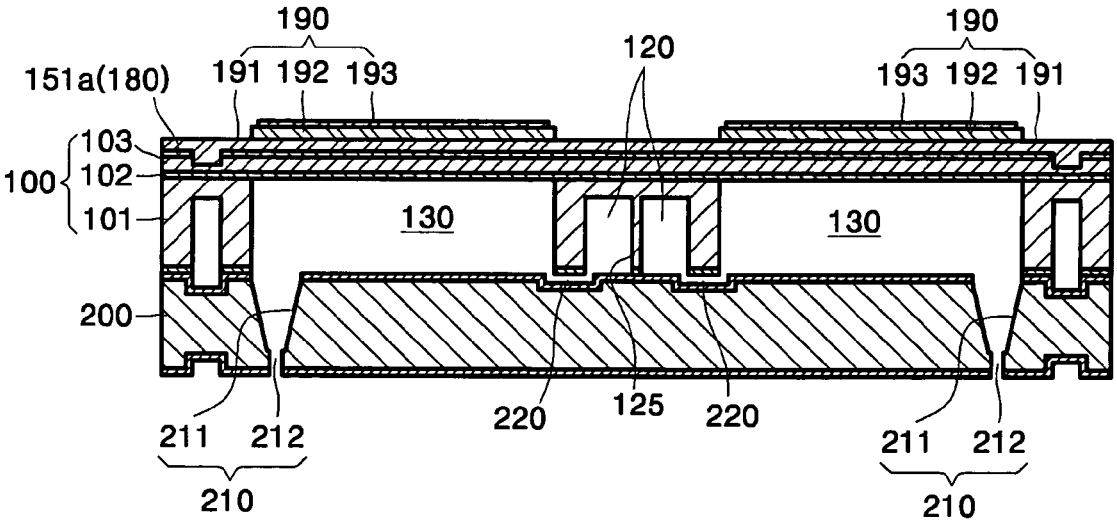
FIG. 13 illustrates a sectional view in a stage of forming a piezoelectric actuator on the upper substrate to complete the piezoelectric inkjet printhead of FIG. 4 in the method of manufacturing the same, according to an embodiment of the present invention.

FIG. 13 illustrates a sectional view in a stage of forming a piezoelectric actuator on the upper substrate to complete the piezoelectric inkjet printhead of FIG. 4 in the method of manufacturing the same, according to an embodiment of the present invention. Referring to FIG. 13, with the upper substrate 100 stacked on and bonded to the lower substrate 200, a silicon oxide layer 180 may be formed on the upper substrate 100 as an insulation layer. However, forming the silicon oxide layer 180 may be omitted, since the silicon oxide layer 151*a* is already formed on the upper surface of the upper substrate 100 during the process of manufacturing the upper substrate 100.

A lower electrode 191, for a piezoelectric actuator, may be formed on the silicon oxide layer 180. The lower electrode 191 may include two thin metal layers of, e.g., Ti and Pt. The lower electrode 191 may be formed by, e.g., sputtering Ti and Pt to a predetermined thickness on the entire surface of the silicon oxide layer 180.

A piezoelectric layer 192 and an upper electrode 193 may be formed on the lower electrode 191. For example, a piezoelectric material in paste form may be coated to a predetermined thickness on the upper surface of the pressure chambers 130 using, e.g., screen printing, and then dried. The piezoelectric material may include a variety of materials such as, e.g., a PZT ceramic material. Subsequently, an electrode material, e.g., a Ag—Pd paste, may be printed on the dried piezoelectric layer 192 to form the upper electrode 193. The piezoelectric layer 192 and the upper electrode 193 may then be sintered at a temperature in the range of, e.g., about 900-1000° C. Thus, an electrically-activated piezoelectric actuator 190 may be formed on the upper substrate 100, the piezoelectric actuator 190 including, the lower electrode 191, the piezoelectric layer 192 and the upper electrode 193.

Finally, the ink inlet 110 may be completed. The ink inlet 110 may be partially formed in the lower surface of the upper substrate 100 during the operation illustrated in FIG. 10G, as described above, and may have a depth corresponding to the pressure chambers 130, after which it may be formed to pass through the upper substrate by post-processing. For example, a thin portion of the upper substrate 100 remaining in the upper portion of the ink inlet 110 may be taken off using, e.g., an adhesive tape, so that the ink inlet 110 is completed to vertically pass through the upper substrate 100. Thus, through the processes described above, the piezoelectric inkjet printhead according to the present invention may be completed.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims. For example, various etching methods may be used, and the order of the manufacturing operations may be changed.

What is claimed is:

1. A piezoelectric inkjet printhead comprising:

an upper substrate, including:

an ink inlet;

a manifold connected with the ink inlet; and a plurality of pressure chambers arranged along at least one side of the manifold, wherein the ink inlet passes through the upper substrate, and the manifold and the pressure chambers are formed in a lower surface of the upper substrate;

a lower substrate disposed directly adjacent the upper substrate, the lower substrate including:

a plurality of restrictors each connecting the manifold with one end of each of the pressure chambers; and a plurality of nozzles each being formed in a position of the lower substrate that corresponds to the other end of each of the pressure chambers to vertically pass through the lower substrate, wherein the plurality of restrictors are formed in an upper surface of the lower substrate; and a plurality of piezoelectric actuators, the piezoelectric actuators formed on the upper substrate and corresponding to the pressure chambers, wherein:

each of the upper substrate and the lower substrate is a silicon substrate, and the upper substrate is stacked on the lower substrate, the upper substrate includes a first silicon layer and a second silicon layer stacked on each other, the manifold and the plurality of pressure chambers are formed in the first silicon layer, the second silicon layer serves as a vibration plate to be deformed by the piezoelectric actuator, a depth of each of the pressure chambers is substantially the same as a thickness of the first silicon layer, and a depth of the manifold is less than that of each of the pressure chambers.

2. The piezoelectric inkjet printhead as claimed in claim 1, wherein the upper substrate comprises a silicon-on-insulator wafer including an intermediate oxide layer disposed between the first silicon layer and the second silicon layer.

3. The piezoelectric inkjet printhead as claimed in claim 2, wherein the intermediate oxide layer defines a ceiling of the manifold.

4. The piezoelectric inkjet printhead as claimed in claim 1, wherein the manifold extends in a first direction, and the plurality of pressure chambers is arranged in two columns extending in the first direction, the two columns disposed on opposite sides of the manifold.

5. The piezoelectric inkjet printhead as claimed in claim 4, wherein a partition wall is formed inside the manifold and extends in the first direction.

6. The piezoelectric inkjet printhead as claimed in claim 5, wherein one end of each of the restrictors extends about to the partition wall.

7. The piezoelectric inkjet printhead as claimed in claim 1, wherein each of the restrictors includes two parts spaced apart from each other, and the two parts are connected to each other through a connection groove formed to a predetermined depth in a lower surface of the upper substrate.

8. The piezoelectric inkjet printhead as claimed in claim 1, wherein each piezoelectric actuator comprises:

a lower electrode formed on the upper substrate;

a piezoelectric layer formed on the lower electrode, above an upper surface of a corresponding pressure chamber; and an upper electrode formed on the piezoelectric layer.

9. The piezoelectric inkjet printhead as claimed in claim 8, wherein the lower electrode comprises two thin metal layers made of Ti and Pt.

10. The piezoelectric inkjet printhead as claimed in claim 8, wherein a silicon oxide layer is formed as an insulation layer between the upper substrate and the lower electrode.

11. The piezoelectric inkjet printhead as claimed in claim 1, wherein each of the nozzles includes:

an ink entering part formed to a predetermined depth from the upper surface of the lower substrate; and an ink ejection part formed in the lower surface of the lower substrate and communicating with the ink entering part.

12. The piezoelectric inkjet printhead as claimed in claim 11, wherein the ink entering part has a pyramid shape whose cross-section decreases along a direction from the upper surface of the lower substrate to the ink ejection part.

13. A method of manufacturing a piezoelectric inkjet printhead that includes an upper substrate and a lower substrate, the method comprising:

micromachining the upper substrate to form an ink inlet, a manifold connected with the ink inlet, and a plurality of pressure chambers arranged along at least one side of the manifold, wherein the ink inlet passes through the upper substrate, and the manifold and the pressure chambers are formed in a lower surface of the upper substrate;

micromachining the lower substrate to form a plurality of restrictors each connecting the manifold with one end of each of the pressure chambers, and a plurality of nozzles each being formed in a position of the lower substrate that corresponds to the other end of each of the pressure chambers to vertically pass through the lower substrate, wherein the plurality of restrictors are formed in an upper surface of the lower substrate;

stacking the upper substrate directly adjacent the lower substrate and bonding them to each other; and forming a plurality of piezoelectric actuators on the upper substrate, the piezoelectric actuators corresponding to the pressure chambers, wherein:

each of the upper substrate and the lower substrate is a silicon substrate, and the upper substrate is stacked on the lower substrate, the upper substrate includes a first silicon layer and a second silicon layer stacked on each other, the manifold and the plurality of pressure chambers are formed in the first silicon layer, the second silicon layer serves as a vibration plate to be deformed by the piezoelectric actuator, a depth of each of the pressure chambers is substantially the same as a thickness of the first silicon layer, and a depth of the manifold is less than that of each of the pressure chambers.

14. The method as claimed in claim 13, wherein the micromachining of the upper substrate and the micromachining of the lower substrate include forming an alignment mark in each of the upper substrate and the lower substrate, the alignment mark being used as an alignment reference during the bonding of the upper substrate and the lower substrate.

15. The method as claimed in claim 13, wherein the micromachining of the upper substrate further includes forming a partition wall disposed inside the manifold and extending in a length direction of the manifold.

16. The method as claimed in claim 13, wherein the upper and lower substrates are each single crystal silicon substrates and the upper substrate is a silicon-on-insulator wafer having an intermediate oxide layer between the first silicon layer and the second silicon layer.

17. The method as claimed in claim 16, wherein the micromachining of the upper substrate includes forming the pressure chambers and the ink inlet by etching the first silicon layer using the intermediate oxide layer as an etch-stop layer.

18. The method as claimed in claim 17, wherein the micromachining of the upper substrate further comprises forming the manifold to a depth smaller than that of each of the pressure chambers.

19. The method as claimed in claim 18, wherein the micromachining of the upper substrate further comprises:

forming a silicon oxide layer on each of an upper surface and a lower surface of the upper substrate;

patterning the silicon oxide layer to form a first opening for forming the manifold;

patterning the silicon oxide layer to form second openings for forming the pressure chambers and the ink inlet;

initially etching the lower surface of the upper substrate to a predetermined depth through the second openings; and secondarily etching the lower surface of the upper substrate through the first opening and the second openings until the intermediate oxide layer is exposed.

20. The method as claimed in claim 17, wherein the micromachining of the upper substrate further comprises forming the manifold to the same depth as that of each of the pressure chambers.

21. The method as claimed in claim 20, wherein the micromachining of the upper substrate further comprises:

forming a silicon oxide layer on each of an upper surface and a lower surface of the upper substrate;

patterning the silicon oxide layer formed on the lower surface of the upper substrate to form openings for the manifold, the pressure chambers, and the ink inlet; and etching the lower surface of the upper substrate through the openings until the intermediate oxide layer is exposed.

22. The method as claimed in claim 21, wherein the etching of the upper substrate comprises etching the upper substrate using reactive ion etching with inductively coupled plasma.

23. The method as claimed in claim 17, wherein the ink inlet formed in the lower surface of the upper substrate passes through the upper substrate after the forming of the piezoelectric actuator.

24. The method as claimed in claim 13, wherein the micromachining of the lower substrate includes forming each of the restrictors by etching the upper surface of the lower substrate to a predetermined depth.

25. The method as claimed in claim 24, wherein each of the restrictors is divided into two parts spaced apart from each other.

26. The method as claimed in claim 13, wherein in the micromachining of the lower substrate, each of the nozzles comprises an ink entering part formed to a predetermined depth from the upper surface of the lower substrate, and an ink ejection part formed in the lower surface of the lower substrate and communicating with the ink entering part.

27. The method as claimed in claim 26, wherein the ink entering part is formed by anisotropic wet etching the upper surface of the lower substrate, such that the ink entering part substantially has a pyramid shape whose cross-section decreases along a direction from the upper surface of the lower substrate to the ink ejection part.

28. The method as claimed in claim 26, wherein the ink ejection part is formed by dry etching the lower surface of the lower substrate such that the ink ejection part communicates with the ink entering part.

29. The method as claimed in claim 13, wherein the bonding of the upper substrate and the lower substrate comprises bonding the upper substrate and the lower substrate using silicon direct bonding.

30. The method as claimed in claim 13, wherein the forming of the piezoelectric actuators comprises:

forming a lower electrode on the upper substrate;

forming a piezoelectric layer on the lower electrode; and forming an upper electrode on the piezoelectric layer.

31. The method as claimed in claim 30, wherein the lower electrode is formed by sputtering Ti and Pt to a predetermined thickness on the upper substrate.

32. A piezoelectric inkjet printhead comprising:

an upper substrate, including:

an ink inlet;

a manifold connected with the ink inlet; and a plurality of pressure chambers arranged along at least one side of the manifold, wherein the ink inlet passes through the upper substrate, and the manifold and the pressure chambers are formed in a lower surface of the upper substrate;

a lower substrate disposed directly adjacent the upper substrate, the lower substrate including:

a plurality of restrictors each connecting the manifold with one end of each of the pressure chambers; and a plurality of nozzles each being formed in a position of the lower substrate that corresponds to the other end of each of the pressure chambers to vertically pass through the lower substrate, wherein the plurality of restrictors are formed in an upper surface of the lower substrate; and a plurality of piezoelectric actuators, the piezoelectric actuators formed on the upper substrate and corresponding to the pressure chambers, wherein:

each of the restrictors includes two parts spaced apart from each other, and the two parts are connected to each other through a connection groove formed to a predetermined depth in a lower surface of the upper substrate.

33. The piezoelectric inkjet printhead as claimed in claim 32, wherein the lower substrate includes, in each restrictor, a projection extending toward a corresponding connection groove in the upper substrate.

34. The piezoelectric inkjet printhead as claimed in claim 32, wherein:

each of the upper substrate and the lower substrate is a silicon substrate, and the upper substrate is stacked on the lower substrate, the upper substrate includes a silicon-on-insulator wafer including a first silicon layer, an intermediate oxide layer, and a second silicon layer sequentially stacked on each other, the manifold and the plurality of pressure chambers are formed in the first silicon layer, and the second silicon layer serves as a vibration plate to be deformed by the piezoelectric actuator.

35. The piezoelectric inkjet printhead as claimed in claim 34, wherein the intermediate oxide layer defines a ceiling of the manifold.

* * * * *